US011608589B2

(12) United States Patent
Tran-Thi et al.

(10) Patent No.: US 11,608,589 B2
(45) Date of Patent: Mar. 21, 2023

(54) METHOD FOR COATING TEXTILE MATERIALS

(71) Applicants: COMMISSARIAT A L'ENERGIE ATOMIQUE ET AUX ENERGIES ALTERNATIVES, Paris (FR);
(Continued)

(72) Inventors: Thu-Hoa Tran-Thi, Montrouge (FR); Philippe Charton, Boulogne Billancourt (FR); Franck Tirard, Boulogne Billancourt (FR); Eva Grinenval, Epinal (FR); Sébastien Chatard, Epinal (FR)

(73) Assignees: COMMISSARIAT A L'ENERGIE ATOMIQUE ET AUX ENERGIES ALTERNATIVES, Paris (FR);
(Continued)

( * ) Notice: Subject to any disclaimer, the term of this patent is extended or adjusted under 35 U.S.C. 154(b) by 273 days.

(21) Appl. No.: 16/476,162

(22) PCT Filed: Jan. 8, 2018

(86) PCT No.: PCT/FR2018/050031
§ 371 (c)(1),
(2) Date: Jul. 5, 2019

(87) PCT Pub. No.: WO2018/127672
PCT Pub. Date: Jul. 12, 2018

(65) Prior Publication Data
US 2019/0352841 A1 Nov. 21, 2019

(30) Foreign Application Priority Data
Jan. 6, 2017 (FR) ..... 17 50141

(51) Int. Cl.
*D06M 11/74* (2006.01)
*D06M 11/73* (2006.01)
(Continued)

(52) U.S. Cl.
CPC ..... *D06M 11/73* (2013.01); *A62D 5/00* (2013.01); *D06M 11/74* (2013.01);
(Continued)

(58) Field of Classification Search
CPC .... D06M 11/74; D06M 13/507; D06M 23/08; D06M 2400/02
See application file for complete search history.

(56) References Cited

U.S. PATENT DOCUMENTS 2,596,154 A * 5/1952 Keating ..... B32B 27/00 68/244
2,757,152 A * 7/1956 Solomon ..... D06M 15/423 524/598
(Continued)

FOREIGN PATENT DOCUMENTS

CN 1632215 A 6/2005
CN 1668344 A 9/2005
(Continued)

OTHER PUBLICATIONS

Translation of International Search Report and Written Opinion of the International Searching Authority dated Apr. 16, 2018 in corresponding International application No. PCT/FR2018/050031; 15 pages.
(Continued)

*Primary Examiner* — Nathan H Empie
(74) *Attorney, Agent, or Firm* — Maier & Maier, PLLC

(57) ABSTRACT

A method for coating a textile material, said method includes the following steps: a) incorporating activated carbon in powder form into a coating composition including an aque-
(Continued)

ous solvent and at least one organosilicon precursor, wherein the organosilicon precursor represents from 5 to 50% by volume relative to the whole of the aqueous solvent and organosilicon precursor, b) impregnating the textile material with the coating composition by padding and c) drying the impregnated textile material, characterised in that the coating composition contains no polycarboxylic acid or catalyst.

14 Claims, 6 Drawing Sheets

(71) Applicants: CENTRE NATIONAL DE LA RECHERCHE SCIENTIFIQUE-CNRS-, Paris (FR); SAFRAN ELECTRONICS & DEFENSE, Boulogne-Billancourt (FR); EUROPROTECT FRANCE SA, Epinal (FR)

(73) Assignees: CENTRE NATIONAL DE LA RECHERCHE SCIENTIFIQUE—CNRS-, Paris (FR); SAFRAN ELECTRONICS & DEFENSE, Boulogne-Billancourt (FR); EUROPROTECT FRANCE SA, Epinal (FR)

(51) Int. Cl.

| | |
|---|---|
| ***A62D 5/00*** | (2006.01) |
| ***D06M 13/507*** | (2006.01) |
| ***D06M 23/08*** | (2006.01) |
| *D06M 101/06* | (2006.01) |
| *D06M 101/36* | (2006.01) |

(52) U.S. Cl.
CPC ..... *D06M 13/507* (2013.01); *D06M 23/08* (2013.01); *D06M 2101/06* (2013.01); *D06M 2101/36* (2013.01); *D06M 2200/11* (2013.01); *D06M 2200/12* (2013.01); *D06M 2400/02* (2013.01)

(56) References Cited

U.S. PATENT DOCUMENTS

| | | | | |
|---|---|---|---|---|
| 6,844,122 | B2 | 1/2005 | Haggquist | |
| 8,926,744 | B2 | 1/2015 | Bruckmann et al. | |
| 2002/0006518 | A1 | 1/2002 | Lustig et al. | |
| 2004/0020367 | A1* | 2/2004 | Soane ..... | B01D 46/2411 96/226 |
| 2005/0084761 | A1* | 4/2005 | Hennige ..... | H01M 50/44 429/247 |
| 2009/0223411 | A1 | 9/2009 | Higgins et al. | |
| 2011/0011409 | A1 | 1/2011 | Atkins | |
| 2012/0192876 | A1* | 8/2012 | Fujimori ..... | A61K 33/34 128/863 |

FOREIGN PATENT DOCUMENTS

| | | | |
|---|---|---|---|
| CN | 1846988 | A | 10/2006 |
| CN | 1938072 | A | 3/2007 |
| CN | 101039801 | A | 9/2007 |
| CN | 101160169 | A | 4/2008 |
| CN | 101218317 | A | 7/2008 |
| CN | 101318660 | A | 12/2008 |
| CN | 101711886 | A | 5/2010 |
| CN | 101787654 | A | 7/2010 |
| CN | 101795856 | A | 8/2010 |
| CN | 102371125 | A | 3/2012 |
| CN | 103334298 | A | 10/2013 |
| CN | 203776206 | U | 8/2014 |
| CN | 104492165 | A | 4/2015 |
| CN | 104801279 | A | 7/2015 |
| CN | 102529254 | B | 3/2016 |
| DE | 202005013330 | U1 | 11/2006 |
| DE | 102005031711 | A1 | 6/2007 |
| DE | 202008016598 | U1 | 3/2009 |
| FR | 2678172 | A1 | 12/1992 |
| FR | 2819420 | A1 | 7/2002 |
| FR | 2868956 | A1 | 10/2005 |
| FR | 2984343 | A1 | 6/2013 |
| JP | 2000119956 | A | 4/2000 |
| SK | 500372013 | U1 | 9/2013 |
| TW | 200951269 | A | 12/2009 |
| WO | 2015/163969 | A2 | 10/2015 |

OTHER PUBLICATIONS

Database WPI Week 201118 Thomson Scientific, London, GB; AN 2010-G59638 XP002773267, Published: Dec. 16, 2009, 7 pgs.
A.S. Hockenberger; "Chapter 11 Surface modification of textiles for composite and filtration applications"; Surface Modification of Textiles; Woodhead Publishing in Textiles: No. 97 ; Sep. 9, 2009; pp. 238-268.
Lifen Liu et al.; "Adsorptive removal and oxidation of organic pollutants from water using a novel membrane"; Chemical Engineering Journal; vol. 156; 2010; pp. 553-556.
Marie-Christine Brochier Salon et al.; "Silane adsorption onto cellulose fibers: Hydrolysis and condensation reactions"; Journal of Colloid Interface Science; vol. 289; 2005; pp. 249-261.
Mekki Abdelmouleh et al.; "Interaction of Silane Coupling Agents with Cellulose"; Langmuir; vol. 18; 2002; pp. 3203-3208.
B. Mahltig et al.; "Hydrophobic Silica Sol Coatings on Textiles—the Influence of Solvent and Sol Concentration"; Journal of Sol-Gel Science and Technology; vol. 34; 2005; pp. 103-109.
Benjamin Curdts et al.; "Novel silica-based adsorbents with activated carbon structure"; Microporous and Mesoporous Materials; vol. 210; 2015; pp. 202-205.
Youji Li et al.; "Activated carbon supported TiO2-photocatalysis doped with Fe ions for continuous treatment of dye wastewater in a dynamic reactor"; Journal of Environmental Sciences; vol. 22; No. 8; 2010; pp. 1290-1296.
Meltem Asilturk et al.; "TiO2-activated carbon photocatalysts: Preparation, characterization and photocatalytic activities"; Chemical Engineering Journal; vol. 180; 2012; pp. 354-363.
Hongmei Hou, et al.; "Supercritically treated TiO2-activated carbon composites for cleaning ammonia"; Journal of Wood Science; vol. 52; 2006; pp. 533-538.
Biao Huang et al.; "Photocatalytic activity of TiO2 crystallite-activated carbon composites prepared in supercritical isopropanol for the decomposition of formaldehyde"; Journal of Wood Science; vol. 49; 2003; pp. 79-85.
Juan Zhang et al.; "Photocatalytic oxidation of dibenzothiophene using TiO2/bamboo charcoal"; Journal of Materials Science; vol. 44; 2009; pp. 3112-3117.
Karran Woan et al.; "Photocatalytic Carbon-Nanotube-TiO2 Composites"; Advanced Materials; vol. 21; 2009; pp. 2233-2239.
K.Y. Foo et al.;"Decontamination of textile wastewater via TiO2/activated carbon composite materials"; Advances in Colloid and Interface Science; vol. 159; 2010; pp. 130-143.
Hu. "Forming Technology of Fiber Ensembles 2: Multi-dimentional Shaping." Donghua University Press. Mar. 31, 2016. 4 pp., including partial English translation.
Levine. "The Functional Arrangement of Textiles." Textile Industry Press. May 31, 1992. 4 pp., including partial English translation.
Chinese Search Report dated Jul. 12, 2021, in connection with corresponding CN Application No. 2018800079556 (4 pp., including machine-generated English translation).

* cited by examiner

A B

METHOD FOR COATING TEXTILE MATERIALS

FIELD

The invention relates to a novel process for coating textile materials for the preparation of coated textiles with gas-barrier properties.

BACKGROUND

Nowadays, the use of active charcoal in gas filtration is the appropriate solution. However, the trapping of small-sized and polar toxic molecules with active charcoal is poor, and it has to be impregnated with various suitable chemical products in order to make up for this inefficiency. Active charcoal is found in various forms of media mixed with textile: textiles impregnated with active charcoal and ironed, or active charcoal bonded to fabric. In these cases, it becomes difficult to wash the clothing without losing the initial properties of the clothing. To obtain good protection against chemical hazards, a large quantity of active charcoal is necessary, which makes the clothing heavy. Moreover, for protection against the spraying of corrosive and/or toxic liquids, it is necessary to have a water-repellant fabric, which is either hydrophobic or both hydrophobic and oleophobic depending on the field of activity. Another property desired for protective clothing is its resistance to wear by abrasion or washing.

The most efficient solutions are found for military applications. Protection against chemical and biological hazards concerns various protective articles (clothing, gloves, socks, balaclavas, masks) intended to avoid the contact of toxic agents (in liquid or gaseous form) via the cutaneous and respiratory pathways. Thus, two ranges of protective articles exist: those produced based on leaktight materials and those employing filtering and/or breathable (permeable) materials.

With a leaktight material, the wearer is perfectly protected against external hazards, but his body cannot exchange heat and moisture with the external medium. Prolonged wearing of this type of clothing thus irretrievably leads to hyperthermia problems which may become fatal. In order to overcome this problem, clothing employing materials that are permeable to air and to water vapor have been developed. These types of clothing use a combination of textile materials including several layers. At the present time, NBC (nuclear, bacteriological, chemical) military protective clothing consists of two layers having the following features and functions. The outer layer has the main functions of ensuring the robustness of the clothing (abrasion resistance and tear strength) and of ensuring that toxic warfare products in liquid form do not penetrate. The non-penetration of toxic warfare products in the liquid form corresponds to the water repellency function (hydrophobicity/oleophobicity). This function is obtained by surface treatment of the outer fabric with a fluoro resin. The inner layer performs the function of filtration of toxic substances in gaseous form. This function is obtained using active charcoal in various forms.

The prior art reveals several inventions relating to the inner layer (filtration function) of NBC military protective clothing. The active charcoal may be in various forms.

Patent application EP 1468732 A2 describes an active charcoal monolayer which is bonded to a textile material in the inner lining. These active charcoal beads preferentially have a specific surface area of from 900 to 1200 $m^2/g$.

In patents CN104492165 and CN102529254B, active charcoal beads (0.1 to 0.4 mm) are integrated into a textile (woven or nonwoven) by mixing them with hot-melt fibers, non-hot-melt fibers, a dispersant and water. The whole is heated to between 80 and 150° C. and compressed. The intended applications relate to filtration: gas masks, protective clothing, air filters.

U.S. Pat. No. 6,844,122 describes a process for printing particles, notably of active charcoal or of silica, onto a support which may be a textile (woven, nonwoven, yarn, etc.). Many applications are mentioned concerning filtration and protection (chemical, bacterial, anti-fire, etc).

Patent application FR 2868956 A1 describes an active charcoal mesh whose adsorption properties are characterized by a preferential specific surface area from about 800 to 1200 $m^2/g$ and by a preferred percentage of microporosity of from 80% to 100%.

In patent application FR 2678172 A1, the active charcoal is in the form of a polyurethane foam impregnated with active charcoal. The polyurethane foam layer is impregnated with active charcoal and then compressed and backed onto a cloth.

Patent application US 2011/0114095 A1 describes an active charcoal fabric impregnated with metals for obtaining antiviral and virucidal properties. This textile is an active charcoal fabric impregnated with metal such as silver or copper which are known to be antibacterial, and derivatives thereof (oxides, ions, nanoparticles).

Patent application WO 2015/163969 A2 describes an active charcoal fabric containing metal oxide nanoparticles for gas filters or for liquid purification. The specific surface area of the active charcoal fabric is given as being between 100 and 2000 $m^2/g$. The mean pore diameter of the active charcoal is between 0.3 and 3 nm and represents 30% to 50% of the overall porosity.

An activated texture made of carbon fibers having bactericidal activity is described in patent application FR 2819420 A1. This activity is due to treatment with an adjuvant that is active against the effects of biological agents such as silver salts, quaternary ammonium salts, copper salts, organophosphorus compounds, and mixtures thereof. The BET specific surface area of the activated texture is generally of the order of 1000 to 1200 $m^2/g$ approximately.

Textile/sol-gel mixed media may be used in particle, gas and liquid filtration processes (Surface Modification of Textiles, Q. Wei, 352 pages, Woodhead Publishing Series in Textiles, 1st Edition (Sep. 9, 2009), ISBN-13: 978-1845694197, Chapter 11 "Surface modification of textiles for composite and filtration applications").

The prior art reveals that, in the majority of the cases, it is a matter of filtering liquids and more particularly water. To retain pollutants such as heavy metals ($Cu^{2+}$, $Hg^{2+}$), silicon precursors functionalized with amine functions, N-[3-(trimethoxysilyl)propyl]ethylenediamine, are used (CN 101787654). Other porous membranes based on sol-gel, deposited on textile materials (viscose, polyester, polyethylene, polypropylene, styrene-butadiene) are obtained with pore sizes ranging from 10 to 1000 nm and are used for treating waste water or drinking water (CN 102371125). Liu et al. combine the use of active charcoal powder with a $Ce^{3+}$—$TiO_2$ photocatalytic system, these being immobilized via a sol-gel membrane, for decontaminating water and in particular removing bisphenol A (Chem. Eng. J., 2010, 156, 3, 553-556, Adsorptive removal and oxidation of organic pollutants from water using novel membrane).

In the field of filtration of air and gases with sol-gel textiles, very few studies exist. Chen et al. have proposed textile fibers (polyolefin, polyester, polyamide) impregnated with sol-gel based on vinyltrimethoxysilane as air filters for air conditioning machines (CN 1632215). Other filtering textiles contain antibacterial agents (DE 102005031711) or fungicides, insecticides, repellants, odoriferous substances, essential oils (DE 202008016598). The sol-gel process is also at the origin of patent application SK 500372013 and concerns a multifunctional textile with a camouflage effect, which is hydrophobic, self-cleaning and antibacterial. However, the patent application relates more to the properties of the fabric (weight, composition, armoring, mechanical properties) than to the sol-gel formulations themselves. It is only mentioned that a hydrophobic coating is obtained by means of a mixture of organosilanes containing a biogen or nanoparticles based on silver ions, or a hydrophobic/antibacterial mixed coating.

The durability of the coating is also an important property for textiles used for civilian or military clothing for protecting against toxic chemicals. It also reflects the attachment of the sol-gel to the textile. In the case of materials such as cotton or cellulose, the adhesion of the sol-gel is readily increased by the chemical condensation of silanol groups with the hydroxyl groups of the textile surface: the nature of the sol-gel itself suffices to allow its attachment to certain types of textile fibers (J. Colloid Interf. Sci. 2005, 289, 249-261, Silane adsorption onto cellulose fibers: Hydrolysis and condensation reactions, M.-C. B. Salon, M. Abdelmouleh, S. Boufi, M. N. Belgacem, A. Gandini). The chemical condensation of silicon alkoxides to cellulose is known to appear after heat treatment above 100° C. (Langmuir 2005, 18, 3203-3208, Interaction of Silane Coupling Agents with Cellulose, M. Abdelmouleh, S. Boufi, A. B. Salah, M. N. Belgacem, A. Gandini). In practice, this is coherent since the deposits of sol-gel on fabric, for example according to the process described in FR 2984343 A1, are preferentially dried between 120 and 180° C. in order to ensure the condensation of the sol-gel precursors, the removal of solvents and the condensation reaction of the acid anhydrides catalyzed with sodium hypophosphite.

Patent application FR 2984343 A1 reports that the attachment of the sol-gel formulation to the fabric may be performed by incorporating polycarboxylic acid and a catalyst (sodium hypophosphite). The role of the polycarboxylic acid is to promote the bridging between the material and the hydrolyzed silicon precursors. The role of the catalyst is to ensure the grafting of the polycarboxylic acid to the material by catalyzing the formation of an acid anhydride intermediate from the polycarboxylic acid (formation of an ester function with the free alcohol functions at the surface of the support). The object of these two chemical compounds is thus to improve the chemical attachment of the polycondensed chains. The durability of the coating is asserted to be improved, notably with respect to abrasion and washing. Tests concerning the durability with respect to washing and the abrasion resistance are reported for the only implementation example given using a sol-gel formulation based on the hydrophobic silane hexadecyltrimethoxysilane.

In many cases, the surface state of the sol-gel is described as being smooth with organic solvents, whereas the same sol-gel prepared in water leads to coatings forming cracks (J. Sol-Gel Sci. Technol. 2005, 34, 103-109, Hydrophobic Silica Sol Coatings on Textiles—the Influence of Solvent and Sol Concentration, B. Mahltig, F. Audenaert, H. Bötcher). According to Mahltig et al., this effect takes place mainly for synthetic fibers which are relative hydrophobic. A certain amount of a solvent that is less polar than water improves the wetting of these materials and thus improves the resulting coating. The article by Mahltig et al. mentions the influence of the solvent and the dilution of the sol-gel. The resulting cracks accelerate the abrasion of the fabric.

Other studies mention the use of organosols (organic-inorganic mixed sol-gel precursors) for the impregnation of textiles. U.S. Pat. No. 8,926,744 B2 claims a large number of sol-gel formulations, most involving commercial silicon precursors and the absence of dispersants in the formulations. The most important object targeted in said patent is the stabilization of the formulations for the storage of the sol and delayed use of said sol for various applications, such as for coatings on solid substrates or for the impregnation of textiles, with, for this last example, dilution of the formulation with water. The process used, the Advantex process, is complex and involves several steps: the first corresponds to reaction between three silicon precursors, a functionalized alkoxysilane, a cyclic siloxane and a methylated and hydrogenated siloxane in the presence of catalysts to obtain a methylated and methylated-hydrogenated mixed polysiloxane (product A). The $2^{nd}$ step corresponds to the reaction of said product with an allylic derivative (C3H5R) bearing a function in the presence of a catalyst (Pt) for the transformation of the SiH groups of compound A into Si—C2H4R bearing the function R. The reactions take place in organic solvents, and in particular in alcohols, which must be partially removed under partial vacuum at 150° C. Variants of this protocol are proposed, depending on the siloxanes and silicon precursors used.

For applications concerning textiles, the authors claim the feel of the fabric (softness of the treated cloth), the resistance to the penetration of a sewing machine needle, the abrasion resistance (9000 to 31 000 cycles in the Martindale test for various textiles and formulations). The filtration/barrier properties do not form part of the intended applications. Similarly, the notions of porosity, pore size distribution of the coating material and environment of the intrapore environment, or permeability are not mentioned.

The combination of porous sol-gel materials with active charcoal has also been studied. In certain studies, the use of active charcoal constitutes only one step in the process for forming the porous sol-gel. Curdts et al. (Novel silica-based adsorbents with activated carbon structure, Microporous and Mesoporous Materials 210 (2015) 202-205) report, for example, a process for impregnating active charcoal with silicon by infiltration in the gaseous route under partial vacuum with tetramethylsilane heated to 943 K. The active charcoal is then burnt to form porous silica granules. An application in the field of textile clothings is not mentioned. Patent application CN 101318660 A describes the synthesis of carbon beads from acetylene, which beads are coated with sol-gel. These beads are then burnt to obtain empty, porous silica shells. No particular application is mentioned.

In other studies, active charcoal is found combined with $TiO_2$ produced via a sol-gel route. In the majority of the cases, this combination is produced for the purpose of optimizing the catalysis of $TiO_2$. Several authors describe the preparation of active charcoal grains coated with $TiO_2$ via a sol-gel route. The intended applications are the decontamination of water, in particular waste waters containing dyes (Youji Li et al. Activated carbon supported $TiO_2$-photocatalysis doped with Fe ions for continuous treatment of dye wastewater in a dynamic reactor, Journal of Environmental Sciences 2010, 22(8) 1290-1296; K. Y. Foo et al., Decontamination of textile wastewater via TiO2/activated carbon composite materials, Advances in colloid and interface science 159 (2010) 130-143), the degradation of rhodamine B (Meltem Asiltürk et al., TiO2-activated carbon photocatalysts: Preparation, characterization and photocatalytic activities, Chemical Engineering Journal 180 (2012) 354-363), and also the decomposition of $NH_3$ or of formaldehyde (Hongmei Hou, Hisashi Miyafuji, Haruo Kawamoto, Supercritically treated $TiO_2$-activated carbon composites for cleaning ammonia, Journal of wood science 53 (2006) 533-538; Biao Huang et al., Photocatalytic activity of TiO2 crystallite-activated carbon composites prepared in supercritical isopropanol for the decomposition of formaldehyde, Journal of wood science 49 (2003) 79-85).

Juan Zhang et al. (Photocatalytic oxidation of dibenzothiophene using $TiO_2$/bamboo charcoal, Journal of materials science 44 (2009) 3112-3117) describe the deposition of a $TiO_2$ powder synthesized via a sol-gel route on active charcoal by impregnation. The object is to decontaminate liquids containing dibenzothiophene.

Karran Woan et al. (Photocatalytic carbon-nanotube-$TiO_2$ composites, Advanced materials 21 (2009) 2233-2239) describe the combination of $TiO_2$ obtained via the sol-gel method with carbon nanotubes by grafting or coating. The aim here also is to improve the $TiO_2$ photocatalysis yield, with applications in the environmental sector.

Finally, combinations of sol-gel materials with active charcoal for applications in the field of filtration have been proposed. The object of these studies is to combine the complementary properties of the two materials, namely the mechanical strength, the modulable porosity and the modulable polarity of the porous sol-gel material and the very great adsorption capacity of active charcoal.

In patent application CN104801279, active charcoal in particle form is modified by impregnation with a sol-gel solution containing amine functions for the purpose of improving its adsorption capacities, notably of the $CO_2$ contained in the air.

Patent application CN103334298 describes a textile composed of active charcoal fibers (0.1-1 mm) coated with silica (Aerogel—5-30 wt %). The fibers are immersed in a sol-gel solution before being dried. Many properties are claimed: mechanical performance, adsorption, fire-resistance properties, antiviral properties, lightness. The targeted applications concern highly protective clothing, in particular for the biochemical sector, and equipment for firemen and military personnel.

The prior art demonstrates that active charcoal is a material that is very widely used in the field of filtration, where it is often combined with textiles. Furthermore, the processes for combining these two materials are quite varied. In the simplest cases, active charcoal particles are attached to a textile by means of adhesive, but this has the drawback of blocking some of the pores of the active charcoal and of reducing its filtration performance. In other processes, the active charcoal is trapped in a nonwoven or a foam. Finally, the remaining prior art solutions consist in producing an active charcoal fabric, either by weaving active charcoal fibers or by performing a heat treatment on a fabric of natural or synthetic fibers. They have, however, an appreciable drawback, since the textiles obtained have poor mechanical strength and are therefore relatively fragile.

Moreover, active charcoal has in recent years been combined with sol-gels. It is used in the majority of cases in order to increase the photocatalytic yield of TiO2. Studies combining active charcoal with a sol-gel based on silicon are less common. The active charcoal may simply act therein as support before being removed by carbonization, and is not present in the final product obtained. Finally, two patent applications describe the coating of active charcoal (particles or fibers) with a silicon-based sol-gel material, with applications in the field of filtration or of high-protection clothing. However, none of these solutions target the filtration of toxic compounds, patent CN104801279 targeting the trapping of $CO_2$ and patent CN103334298 targeting thermal insulation in the case of clothing for firemen and military personnel.

In the light of the foregoing, there is still a need for a textile material which notably allies a high capacity of filtration of various types of polar and apolar molecules, and mechanical strength. Such a material must notably:

- be able to stop polar and nonpolar toxic products and in particular the small-sized polar molecules which active charcoal traps poorly, while at the same time allowing water vapor and air to pass through;
- ensure the air permeability/filtration compromise.

One aim of the invention is thus to propose a simple and efficient process for manufacturing a coated textile which makes it possible to achieve these performance qualities.

The inventors have discovered, to their credit, very unexpectedly and after considerable research, that it is possible to achieve this aim with a process for simple and efficient binding of active charcoal to a textile material by combining the application of the active charcoal with the application of a sol-gel material.

A sol-gel material is a material obtained via a sol-gel process which consists in using as precursors metal alkoxides of formula $M(OR)_xR'_{n-x}$ in which M is a metal, notably silicon, R is an alkyl group and R' is a group bearing one or more functions with n=4 and x possibly ranging between 2 and 4. In the presence of water, the alkoxy (OR) groups are hydrolyzed to silanol (Si—OH) groups. The latter groups condense to form siloxane bonds (Si—O—Si—). Small particles generally less than 1 μm in size are formed, and aggregate to form lumps which remain in suspension without precipitating, forming a sol. The increase of the lumps and their condensation increases the viscosity of the medium, which gels. A porous solid material is obtained by drying the gel, with the expulsion of the solvent out of the polymer network formed (syneresis).

SUMMARY

One subject of the invention thus relates to a process for coating a textile material, said process comprising the following steps:

a) incorporating active charcoal in powder form into a coating composition comprising an aqueous solvent and at least one organosilicon precursor, in which the organosilicon precursor represents 5% to 50% by volume relative to the combination of aqueous solvent and organosilicon precursor, b) impregnating the textile material by padding with the coating composition, and c) drying the impregnated textile material, characterized in that the coating composition is free of polycarboxylic acid and of catalyst.

In contrast with textiles impregnated with a coating composition comprising an aqueous solvent, an organosilicon precursor and polycarboxylic acid prepared according to the prior art and also containing active charcoal, the textiles obtained with the process according to the invention make it possible to filter polar and apolar toxic gases. Surprisingly and unexpectedly, and as demonstrated in example 2, the incorporation of a polycarboxylic acid modifies the sol-gel, making it unsuitable for application in, notably polar, gas filtration.

In contrast with impregnated textiles prepared according to the prior art with a coating composition comprising an aqueous solvent, an organosilicon precursor and polycarboxylic acid and also containing active charcoal, the textiles obtained with the process according to the invention make it possible to filter polar and apolar toxic gases. Surprisingly and unexpectedly, and as demonstrated in example 3, the incorporation of a polycarboxylic acid modifies the sol-gel, making it unsuitable for application in, notably polar, gas filtration.

The coating composition is in addition free of catalyst. Specifically, due to the absence of polycarboxylic acid, the coating composition according to the invention does not require the presence of a catalyst either for the formation of an acid anhydride intermediate from the polycarboxylic acid, for instance phosphorus-based catalysts such as sodium hypophosphite. Thus, the coating composition is notably free of such a catalyst. For the purposes of the invention, the term "catalyst" also comprises acids, notably mineral acids, such as hydrochloric acid, and monocarboxylic acids.

Advantageously, the coating composition is also free of surfactant. Specifically, the presence of surfactant would modify the sol-gel by inducing the formation of a network of large-sized pores, i.e. mesopores (20-500 Å) or even macropores (>500 Å), which would be detrimental to the filtration property.

The impregnated textile material according to the invention is flexible, light, breathable, water-repellant and has polar and nonpolar toxic gas barrier properties.

The textile material used may be of any type. It may be, for example, a fabric, a nonwoven, such as a felt, or a knit, preferably a fabric or a nonwoven such as a felt. Advantageously, the textile material comprises fibers including hydrolyzable functions, such as hydroxyl functions. An example of such a fiber is cellulose, present in natural fibers such as cotton or artificial fibers such as viscose. Preferably, they are viscose fibers. The fibers including hydrolyzable functions may be used alone, as a mixture with each other and/or as a mixture with other synthetic fibers such as polyamide, polyamide/imide, polymetaphenylene terephthalamide, polyparaphenylene terephthalamide, acrylic, modacrylic, polyester terephthalate or oxidized polyacrylonitrile fibers. In a preferred embodiment, the textile material is a material based on an intimate mixture of viscose and of synthetic fibers, preferably of polyamide fibers, notably of aromatic polyamide. Examples of such a fabric are Kermel®/Lenzing FR® 50:50 and Conex®/Lenzing FR® 50:50. In another embodiment, the textile material is a nonwoven, notably a felt. An example of such a felt is the Nomex® from Duflot Industries.

The aqueous solvent used in the coating composition may be water or a mixture of water and of an organic solvent, which is notably polar, protic or aprotic. This organic solvent may be chosen, for example, from linear aliphatic C1 to C4 alcohols, notably methanol, ethanol and 1-propanol. Preferably, the organic solvent is ethanol. The aqueous solvent advantageously contains 50% to 100% by volume of water.

The aqueous solvent advantageously represents 50% to 92% by volume, preferably 55% to 80% by volume and more preferentially 60% to 70% by volume of the coating composition.

The organosilicon precursor used in the coating composition may consist of a single organosilicon precursor or of a mixture of organosilicon precursors. It is advantageously chosen from tetramethoxysilane (TMOS), tetraethoxysilane (TEOS), methyltrimethoxysilane (MTM), methyltriethoxysilane (MTE), phenyltrimethoxysilane (PhTMOS), phenyltriethoxysilane (PhTEOS), a fluoroalkyltrimethoxysilane, a fluoroalkyltriethoxysilane, a chloroalkylmethoxysilane, a chloroalkylethoxysilane, an aminopropyltriethoxysilane, (3-glycidyloxypropyl)trimethoxysilane (GPTMOS) and mixtures thereof, preferably from tetramethoxysilane (TMOS), methyltrimethoxysilane (MTM), phenyltrimethoxysilane (PhTMOS), a fluoroalkyltrimethoxysilane, a chloroalkylmethoxysilane, an aminopropyltriethoxysilane, (3-glycidyloxypropyl)trimethoxysilane (GPTMOS), and mixtures thereof, more preferably from tetramethoxysilane (TMOS), methyltriméthoxysilane (MTM), 1H,1H,2H,2H-perfluoroheptadécyltriethoxysilane (17FTMOS), aminopropyltriethoxysilane (APTES), phenyltrimethoxysilane (PhTMOS), and mixtures thereof. In a particular variant, the organosilicon precursor is chosen from tetramethoxysilane (TMOS), tetraethoxysilane (TEOS), methyltrimethoxysilane (MTM), methyltriethoxysilane (MTE), phenyltrimethoxysilane (PhTMOS), phenyltriethoxysilane (PhTEOS), a fluoroalkyltrimethoxysilane, a fluoroalkyltriethoxysilane, an aminopropyltriethoxysilane, (3-glycidyloxypropyl)trimethoxysilane (GPTMOS), and mixtures thereof, preferably from tetramethoxysilane (TMOS), methyltrimethoxysilane (MTM), phenyltrimethoxysilane (PhTMOS), a fluoroalkyltrimethoxysilane, an aminopropyltriethoxysilane, (3-glycidyloxypropyl)trimethoxysilane (GPTMOS), and mixtures thereof, more preferably from tetramethoxysilane (TMOS), methyltrimethoxysilane (MTM), 1H,1H,2H,2H-perfluoroheptadecyltriethoxysilane (17FTEOS), aminopropyltriethoxysilane (APTES), phenyltrimethoxysilane (PhTMOS), and mixtures thereof.

In one embodiment, the organosilicon precursor is tetramethoxysilane. In another embodiment, the organosilicon precursor is a mixture of tetramethoxysilane and of a precursor chosen from methyltrimethoxysilane (MTM), methyltriethoxysilane (MTE), phenyltrimethoxysilane (PhTMOS), phenyltriethoxysilane (PhTEOS), a fluoroalkyltrimethoxysilane, a fluoroalkyltriethoxysilane, a chloroalkylmethoxysilane, a chloroalkylethoxysilane, an aminopropyltriethoxysilane, (3-glycidyloxypropyl) trimethoxysilane (GPTMOS), and mixtures thereof, preferably from methyltrimethoxysilane (MTM), phenyltrimethoxysilane (PhTMOS), a fluoroalkyltrimethoxysilane, a chloroalkylmethoxysilane, an aminopropyltriethoxysilane, (3-glycidyloxypropyl)trimethoxysilane (GPTMOS), and mixtures thereof, more preferably from methyltrimethoxysilane (MTM), 1H,1H,2H,2H-perfluoroheptadecyltriethoxysilane (17FTMOS), aminopropyltriethoxysilane (APTES), phenyltrimethoxysilane (PhTMOS), and mixtures thereof. In one variant, the mixture does not contain any chloroalkylmethoxysilane or any chloroalkylethoxysilane. Mixtures of preferred organosilicon precursors comprise mixtures of tetramethoxysilane (TMOS) with methyltrimethoxysilane (MTM), with aminopropyltriethoxysilane (APTES), with 1H,1H,2H,2H-perfluoroheptadecyltrimethoxysilane (17FTMOS), and with aminopropyltriethoxysilane (APTES) and 1H,1H,2H,2H-perfluoroheptadecyltriethoxysilane (17FTOS). Particularly good attachment and filtration performance qualities have been obtained with mixtures of TMOS and PhTMOS, respectively.

During the use of a mixture of tetramethoxysilane and of one or more other organosilicon precursors, the molar proportions of tetramethoxysilane (TMOS)/other organosilicon precursor(s) may range between 100/0 and 50/50, preferably between 90/10 and 75/25.

The organosilicon precursor advantageously represents 5% to 50% by volume, relative to the combination of aqueous solvent and organosilicon precursor. If the aqueous solvent is water, the organosilicon precursor preferably represents 8% to 35% by volume relative to the combination of aqueous solvent and organosilicon precursor. By using a mixture of water and of an organic solvent, notably of ethanol (e.g. 90/10 by volume), the precursor may represent up to 50% by volume relative to the combination of aqueous solvent and organosilicon precursor.

The active charcoal used for the present invention may be of plant or animal origin. A person skilled in the art will choose it as a function of the desired properties, notably in terms of filtration. Thus, it is possible to use various forms of active charcoal, for instance beads, powder, granules or fibers. The active charcoal may be mixed in various concentraitons with the coating composition (sol-gel composition) to modulate the amount of active charcoal deposited on the textiles after impregnation.

The incorporation of active charcoal into the sol-gel solution may take place from the start of the reaction up to the moment of impregnation of the textile material. It may be added, for example, at the same time as the sol-gel precursors.

According to a first particular embodiment, the coating composition is applied directly to the textile material. This strategy uses directly the functionality of the organosilicon precursors used for the barrier function for the attachment of the sol-gel to the textile, notably via hydroxyl functions at the surface.

According to a second particular embodiment, the process according to the invention comprises, before step b), a step of applying a precoating composition comprising an organic solvent and a zirconium alkoxide, said precoating composition being free of polycarboxylic acid. Due to the absence of polycarboxylic acid, the precoating composition according to the invention does not itself either require the presence of a catalyst for formation of an acid anhydride intermediate from the polycarboxylic acid, for instance phosphorus-based catalysts such as sodium hypophosphite. Thus, the precoating composition is advantageously free of such a catalyst.

$Zr^{4+}$ has a high coordination number (+7), which promotes the attachment to the textile material via complexation with the functionalities originating from the textile. The application of the coating composition in step b) covers this first attachment layer to form the "barrier" coating. The zirconium alkoxide may be chosen from tetra-n-propyl zirconate (CAS 23519-77-9), tetra-n-butyl zirconate (CAS 1071-76-7), tetra-iso-propyl zirconate (CAS 14717-56-7), tetra-tert-butyl zirconate (2081-12-1), bis(diethylcitrato) dipropyl zirconate (CAS 308847-92-9), bis(2,2,6,6-tetramethyl-3,5-heptanedionate)-di-iso-propyl zirconate (CAS 204522-78-1); tetra-n-propyl zirconate (TPOZ) will preferably be chosen.

The textile material is impregnated by padding with the coating composition containing active charcoal. Padding includes a step of impregnating the textile material in the sol followed by a step of squeezing under pressure which makes it possible to remove the surplus sol. When compared with other coating techniques, for instance dip-coating, this technique makes it possible to obtain a uniform distribution of the sol and also better impregnation of the sol into the fabric. Scanning electron microscopy images show that the application of the coating composition according to the invention by padding results in cladding of the textile fibers. On the other hand, dip-coating results in a non-uniform deposition, essentially at the surface due to the fact that it consists in dipping the textile material in the coating solution followed by removing the textile material vertically. This vertical removal is inevitably accompanied by the formation of a deposition gradient toward the bottom of the textile material. Furthermore, simple dipping in the coating solution does not make it possible to ensure impregnation of the textile material and thus cladding of the fibers. This cladding of the fibers is, however, important to impart the desired properties to the textile material. Particularly good results in terms of cladding of the fibers were obtained with coating compositions having a dynamic viscosity of less than or equal to 10 mPa·s (10 cP). The dynamic viscosity may be measured, for example, using a Physica MCR 301 rheometer sold by the company Anton Paar as described in the examples below.

Step b) of impregnation of the textile material by padding may be performed only once or repeated several times. The process according to the invention may thus include several, notably 1 to 3, successive cycles of impregnation of the textile material by padding.

In one embodiment, the textile material used in step b) of the process according to the invention is dried prior to impregnation with the coating composition so as to remove the water at the surface. This drying is particularly advantageous in the case of textile materials incorporating cellulose fibers such as cotton or viscose. A person skilled in the art knows how to adapt the drying temperature and time as a function of the textile material and of the water content, notably at the surface. Advantageously, the textile material is dried at a temperature of from 80 to 180° C., preferably from 100 to 150° C., more preferably about 120° C. The drying time is advantageously a few minutes, for example from 2 to 10 minutes, notably from 2 to 5 minutes.

Another subject of the invention is a coating composition comprising an aqueous solvent, an organosilicon precursor and active charcoal in powder form as described above.

A subject of the invention is also an impregnated textile material obtained via the coating process according to the invention described above. It is thus a textile material impregnated with a sol-gel material and active charcoal in powder form. All the details and embodiments presented above regarding the nature of the textile material, the sol-gel material and the active charcoal are also valid for the impregnated textile material according to the invention. The impregnated textile material according to the invention is notably characterized in that it has a specific surface area $S_{BET}$ (determined from the adsorption isotherms by means of the Brunauer-Emmet-Teller (BET) model) of between 600±50 and 950±80 $m^2 \cdot g^{-1}$, notably between 700±60 and 940±80 $m^2 \cdot g^{-1}$. The porosity of the impregnated textile material according to the invention was determined from the adsorption isotherms by means of the model based on the density functional theory (DFT). The proportion of micropores (<20 Å) is preferably greater than 40% and even more preferentially greater than 50%. The proportion of mesopores (20 Å-500 Å) is preferably less than 60% and even more preferentially less than 50%. The textile material is preferably free of macropores (>500 Å). The mass per unit area of the sol-gel material may range from 10 to 435 $g/m^2$, preferably from 20 to 400 $g/m^2$, more preferably from 30 to 300 $g/m^2$.

The impregnated textile material according to the invention finds a particular application for gas filtration, notably for personal protection equipment, for instance clothing, notably against toxic chemicals, but also for textiles directed toward protecting the respiratory pathways (masks), textiles which absorb unpleasant odors such as frying odors or tobacco, for instance consumable filters. The invention thus also relates to a filter, notably for gases, comprising the textile material according to the invention.

A particular subject of the invention is personal protection equipment comprising the textile material according to the invention. The personal protection equipment may be, for example, a body suit, trousers, a jacket, gloves, balaclavas, socks or masks. By virtue of the functional properties, notably in terms of filtration of polar and apolar toxic gases of the textile material according to the invention, the personal protection equipment is particularly suitable for NBC (nuclear, bacteriological, chemical) hazards. Thus, in one embodiment, the personal protection equipment is NBC personal protection equipment.

Nonlimiting examples of implementation of the invention are described below.

DETAILED DESCRIPTION

Chemical Products Used

Figure 1:
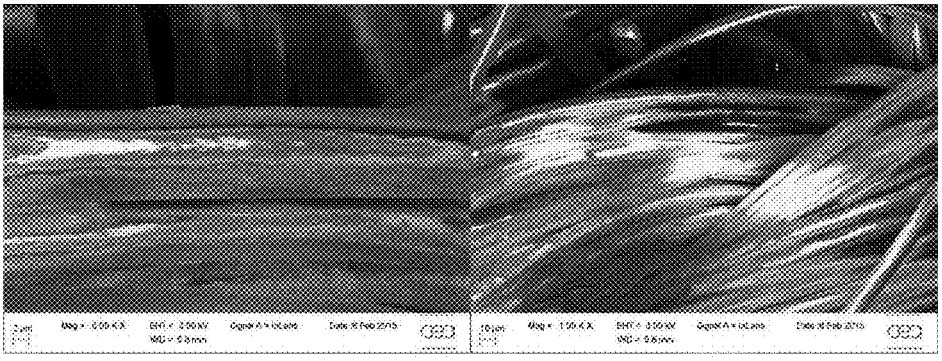
FIG. 1: SEM images of cloth A before impregnation.

Tetramethoxysilane (CAS No.: 681-84-5) (TMOS, Acros Organics, 99%);

Methyltrimethoxysilane (CAS No.: 1185-55-3) (MTM, Sigma-Aldrich, 98%);

1H,1H,2H,2H-Perfluoroheptadecyltriethoxysilane (CAS No.: 101947-16-4) (17FTMOS, Sigma-Aldrich, 97%);

Aminopropyltriethoxysilane (CAS No.: 919-30-2) (APTES, Acros Organics, 99%);

Phenyltrimethoxysilane (CAS No.: 2996-92-1) (PhTMOS, TCI, >98%);

Ethanol (CAS No.: 64-17-5) (Merck, Uvasol for spectroscopy);

Acetonitrile (CAS No.: 75-05-8) (Merck, Lichrosolv gradient grade for liquid chromatography);

Succinic acid (CAS No.: 110-15-6) (Sigma-Aldrich, Reagent Plus ≥99.0%);

Sodium hypophosphite (CAS No.: 123333-67-5) (Sigma-Aldrich, hydrate).

Example 1: Preparation of Coated Fabrics

The formulations according to strategies I, II and III described below were deposited on 5 cm×10 cm to 21 cm×30 cm pieces of cloth: cloth A (50/50 Kermel®/Lenzing FR® fabric (Kermel, Colmar, France) (Lenzing AG, Lenzing, Austria)), cloth B (50/50 Conex®/Lenzing FRO fabric (Teijin Aramid B.V., Arnhem, Netherlands) (Lenzing AG, Lenzing, Austria)) and cloth C (Nomex® felt (Dupont, Wilmington, Del., United States)) by full-bath impregnation and squeezing (padding principle) and the fabrics were then oven-dried for 2 minutes at 120° C. and left to stand for 24 hours at room temperature and atmospheric pressure in the laboratory. The initial amount deposited ranges between 10 and 435 g/m$^2$. The mass per unit area of the sol-gel material is deduced by weighing the fabric before and after impregnation.

I. Preparation of Coated Fabrics According to the Attachment Strategy Described in FR 2984343 A1 (with Polycarboxylic Acid)

Formulation $A_1$ 0.131 g of succinic acid and 0.140 g of sodium hypophosphite are mixed in 17.73 mL of ultra-pure water in a hermetically sealed glass flask. The mixture is stirred on setting 4 of an IKA WERKE RO10 power multiple-stirrer plate (about 500 rpm) and at room temperature (20-22° C.) until the polyacid and the catalyst have dissolved. 0.805 g of active charcoal and 2.300 mL of TMOS are then added to the initial mixture.

Dynamic viscosity: 3.5 cP (mPa·s)

The deposition of this formula onto textile indicates a mass per unit area of 29 g/m$^2$.

Formulation $A_2$ 0.200 g of succinic acid and 0.212 g of sodium hypophosphite are mixed in 27.03 mL of ultra-pure water in a hermetically sealed glass flask. The flask is placed at about 45° C. in a water bath covered with an aluminum foil, on a TECHLAB MAGNETIC STIRRER SH-4C heating stirrer (nominal temperature: 55° C.) and stirred at about 400-500 rpm until the polyacid and the catalyst have dissolved. 3.057 g of active charcoal and 3,600 mL of TMOS are then added to the initial mixture.

Dynamic viscosity: 5.4 cP (mPa·s)

The deposition of this formula onto textile indicates a mass per unit area of 37 g/m$^2$.

Formulation B 0.333 g of succinic acid and 0.354 g of sodium hypophosphite are mixed in 45.06 mL of ultra-pure water in a hermetically sealed glass flask. The mixture is stirred on setting 4 of an IKA WERKE RO10 power multiple-stirrer plate (about 500 rpm) and at room temperature (20-22° C.) until the polyacid and the catalyst have dissolved. 2.033 g of active charcoal, 3.000 mL of TMOS and 2.780 mL of MTM are then added to the initial mixture.

Dynamic viscosity: 2.0 cP (mPa·s)

The deposition of this formula onto textile indicates a mass per unit area of 22 g/m$^2$.

Formulation $C_1$ 0.267 g of succinic acid and 0.284 g of sodium hypophosphite are mixed in 18.02 mL of ultra-pure water and 18.02 mL of ethanol in a hermetically sealed glass flask. The mixture is stirred on setting 4 of the IKA WERKE RO10 power multiple-stirrer plate (about 500 rpm) and at room temperature (20-22° C.) until the polyacid and the catalyst have dissolved. 1.643 g of active charcoal, 4.800 mL of TMOS and 0.226 mL of APTES are then added to the initial mixture.

Dynamic viscosity: 18.7 cP (mPa·s)

The deposition of this formula on textile indicates a mass per unit area of 27 g/m$^2$.

Formulation $C_2$ 0.268 g of succinic acid and 0.284 g of sodium hypophosphite are mixed in 18.02 mL of ultra-pure water and 18.02 mL of ethanol in a hermetically sealed glass flask. The mixture is stirred on setting 4 of the IKA WERKE RO10 power multiple-stirrer plate (about 500 rpm) and at room temperature (20-22° C.) until the polyacid and the catalyst have dissolved. 4.107 g of active charcoal, 4.800 mL of TMOS and 0.226 mL of APTES are then added to the initial mixture.

Dynamic viscosity: 82.5 cP (mPa·s)

The deposition of this formula on textile indicates a mass per unit area of 36 g/m$^2$.

Formulation $D_1$ 0.237 g of succinic acid and 0.252 g of sodium hypophosphite are mixed in 15.98 mL of ultra-pure water and 15.98 mL of ethanol in a hermetically sealed glass flask. The mixture is stirred on setting 4 of the IKA WERKE RO10 power multiple-stirrer plate (about 500 rpm) and at room temperature (20-22° C.) until the polyacid and the catalyst have dissolved. 1.454 g of active charcoal, 4.000 mL of TMOS and 0.402 mL of APTES are then added to the initial mixture.

Dynamic viscosity: 13.5 cP (mPa·s)

The deposition of this formula on textile indicates a mass per unit area of 27 g/m$^2$.

Formulation $D_2$ 0.296 g of succinic acid and 0.314 g of sodium hypophosphite are mixed in 19.97 mL of ultra-pure water and 19.97 mL of ethanol in a hermetically sealed glass flask. The mixture is stirred on setting 4 of the IKA WERKE RO10 power multiple-stirrer plate (about 500 rpm) and at room temperature (20-22° C.) until the polyacid and the catalyst have dissolved. 4.545 g of active charcoal, 5.000 mL of TMOS and 0.502 mL of APTES are then added to the initial mixture.

Dynamic viscosity: 12.4 cP (mPa·s)

The deposition of this formula on textile indicates a mass per unit area of 42 g/m$^2$.

Formulation $E_1$ 0.127 g of succinic acid and 0.135 g of sodium hypophosphite are mixed in 8.57 mL of ultra-pure water in a hermetically sealed glass flask. The mixture is stirred on setting 4 of an IKA WERKE RO10 power multiple-stirrer plate (about 500 rpm) and at room temperature (20-22° C.) until the polyacid and the catalyst have dissolved, followed by addition of 0.773 g of active charcoal. 8.57 mL of ethanol, 0.337 mL of 17FTMOS, 2.100 mL of TMOS and 0.108 mL of APTES are mixed in a second hermetically sealed glass flask. The contents of the second flask are then poured into the first with continued stirring.

Dynamic viscosity: 37.0 cP (mPa·s)

The deposition of this formula on textile indicates a mass per unit area of 30 g/m$^2$.

Formulation $E_2$ 0.127 g of succinic acid and 0.135 g of sodium hypophosphite are mixed in 8.57 mL of ultra-pure water in a hermetically sealed glass flask. The mixture is stirred on setting 4 of an IKA WERKE RO10 power multiple-stirrer plate (about 500 rpm) and at room temperature (20-22° C.) until the polyacid and the catalyst have dissolved, followed by addition of 1.937 g of active charcoal. 8.57 mL of ethanol, 0.337 mL of 17FTMOS, 2.100 mL of TMOS and 0.108 mL of APTES are mixed in a second hermetically sealed glass flask. The contents of the second flask are then poured into the first with continued stirring.

Dynamic viscosity: 50.0 cP (mPa·s)

The deposition of this formula on textile indicates a mass per unit area of 44 g/m$^2$.

Formulation $F_1$ 0.138 g of succinic acid and 0.147 g of sodium hypophosphite are mixed in 9.28 mL of ultra-pure water in a hermetically sealed glass flask. The mixture is stirred on setting 4 of an IKA WERKE RO10 power multiple-stirrer plate (about 500 rpm) and at room temperature (20-22° C.) until the polyacid and the catalyst have dissolved, followed by addition of 0.840 g of active charcoal. 9.28 mL of ethanol, 0.365 mL of 17FTMOS, 2.200 mL of TMOS and 0.233 mL of APTES are mixed in a second hermetically sealed glass flask. The contents of the second flask are then poured into the first flask and stirring of the mixture is continued.

Dynamic viscosity: 20.0 cP (mPa·s)

The deposition of this formula on textile indicates a mass per unit area of 31 g/m$^2$.

Formulation $F_2$ 0.138 g of succinic acid and 0.146 g of sodium hypophosphite are mixed in 9.28 mL of ultra-pure water in a hermetically sealed glass flask. The mixture is stirred on setting 4 of an IKA WERKE RO10 power multiple-stirrer plate (about 500 rpm) and at room temperature (20-22° C.) until the polyacid and the catalyst have dissolved, followed by addition of 2.104 g of active charcoal. 9.28 mL of ethanol, 0.365 mL, of 17FTMOS, 2.200 mL of TMOS and 0.233 mL of APTES are mixed in a second hermetically sealed glass flask. The contents of the second flask are then poured into the first flask and stirring of the mixture is continued.

Dynamic viscosity: 20.0 cP (mPa·s)

The deposition of this formula on textile indicates a mass per unit area of 40 g/m$^2$.

II. Preparation of Coated Fabrics According to an Attachment Strategy without Polycarboxylic Acid in One Step Formulation $A_1$'

2.381 g of active charcoal and then 7.000 mL of TMOS are added to a volume of 52.56 mL of ultra-pure water in a hermetically sealed glass flask. The mixture is stirred at room temperature (20-22° C.) on setting 4 of the IKA WERKE RO10 power multiple-stirrer plate (about 500 rpm).

Dynamic viscosity: 3.1 cP (mPa·s)

The deposition of this formula on textile indicates a mass per unit area of 21 g/m$^2$.

Formulation $A_2$'

5.956 g of active charcoal and then 7.000 mL of TMOS are added to a volume of 52.56 mL of ultra-pure water in a hermetically sealed glass flask. The mixture is stirred at room temperature (20-22° C.) on setting 4 of the IKA WERKE RO10 power multiple-stirrer plate (about 500 rpm).

Dynamic viscosity: 7.3 cP (mPa·s)

The deposition of this formula on textile indicates a mass per unit area of 36 g/m$^2$.

Formulation $D_1$'

1.816 g of active charcoal are mixed with a volume of 19.97 mL of ultra-pure water in a hermetically sealed glass flask. 19.97 mL of ethanol, 5.000 mL of TMOS and 0.502 mL of APTES are mixed in a second hermetically sealed glass flask. The contents of the second flask are then poured into the first flask and the mixture is stirred at room temperature (20-22° C.) on setting 4 of the IKA WERKE RO10 power multiple-stirrer plate (about 500 rpm).

The deposition of this formula on textile indicates a mass per unit area of 28 g/m$^2$.

Formulation $D_2$'

4.541 g of active charcoal are mixed with a volume of 19.97 mL of ultra-pure water in a hermetically sealed glass flask. 19.97 mL of ethanol, 5.000 mL of TMOS and 0.502 mL of APTES are mixed in a second hermetically sealed glass flask. The contents of the second flask are then poured into the first flask and the mixture is stirred at room temperature (20-22° C.) on setting 4 of the IKA WERKE RO10 power multiple-stirrer plate (about 500 rpm).

Dynamic viscosity: 10-12 cP (mPa·s)

The deposition of this formula on textile indicates a mass per unit area of 33 g/m$^2$.

Formulation $E_1$'

1.129 g of active charcoal are mixed with a volume of 12.24 mL of ultra-pure water in a hermetically sealed glass flask. 12.24 mL of ethanol, 0.482 mL of 17FTMOS, 3.000 mL of TMOS and 0.154 mL of APTES are mixed in a second hermetically sealed glass flask. The contents of the second flask are then poured into the first flask and the mixture is stirred at room temperature (20-22° C.) on setting 4 of the IKA WERKE RO10 power multiple-stirrer plate (about 500 rpm).

The deposition of this formula on textile indicates a mass per unit area of 17 g/m$^2$.

Formulation $E_2$'

2.813 g of active charcoal are mixed with a volume of 12.24 mL of ultra-pure water in a hermetically sealed glass flask. 12.24 mL of ethanol, 0.482 mL of 17FTMOS, 3.000 mL of TMOS and 0.154 mL of APTES are mixed in a second hermetically sealed glass flask. The contents of the second flask are then poured into the first flask and the mixture is stirred at room temperature (20-22° C.) on setting 4 of the IKA WERKE RO10 power multiple-stirrer plate (about 500 rpm).

The deposition of this formula on textile indicates a mass per unit area of 35 g/m$^2$.

Formulation $G_1$'

0.200 g of active charcoal are mixed with a volume of 17.52 mL of ultra-pure water in a hermetically sealed glass flask. 2.100 mL of TMOS and 0.293 mL of PhTMOS are then added and the mixture is stirred at room temperature (20-22° C.) on setting 4 of the IKA WERKE RO10 power multiple-stirrer plate (about 500 rpm).

Dynamic viscosity: 1.9 cP (mPa·s)

The deposition of this formula on textile indicates a mass per unit area of 18 g/m$^2$.

Formulation $G_2$'

0.397 g of active charcoal are mixed with a volume of 17.52 mL of ultra-pure water in a hermetically sealed glass flask. 2.100 mL of TMOS and 0.293 mL of PhTMOS are then added and the mixture is stirred at room temperature (20-22° C.) on setting 4 of the IKA WERKE RO10 power multiple-stirrer plate (about 500 rpm).

Dynamic viscosity: 2.8 cP (mPa·s)

The deposition of this formula on textile indicates a mass per unit area of 19 g/m$^2$.

Formulation $H_1$'

0.411 g of active charcoal are mixed with a volume of 18.02 mL of ultra-pure water in a hermetically sealed glass flask. 1.800 mL of TMOS and 0.753 mL of PhTMOS are then added and the mixture is stirred at room temperature (20-22° C.) on setting 4 of the IKA WERKE RO10 power multiple-stirrer plate (about 500 rpm).

Dynamic viscosity: 2.2 cP (mPa·s)

The deposition of this formula on textile indicates a mass per unit area of 20 g/m$^2$.

Formulation $H_2$'

0.823 g of active charcoal are mixed with a volume of 18.02 mL of ultra-pure water in a hermetically sealed glass flask. 1.800 mL of TMOS and 0.753 mL of PhTMOS are then added and the mixture is stirred at room temperature (20-22° C.) on setting 4 of the IKA WERKE RO10 power multiple-stirrer plate (about 500 rpm).

Dynamic viscosity: 13.0 cP (mPa·s)

The deposition of this formula on textile indicates a mass per unit area of 26 g/m$^2$.

Tables 1 and 2 below summarize the masses per unit area obtained for the various formulations. It is recalled that:

- the attachment strategy I according to FR 2984343 A1 is performed with the addition of succinic acid and sodium hypophosphite;
- the one-step attachment strategy II is direct attachment with the silicon-based precursors used.

TABLE 1

| Strategy I | | | | |
|---|---|---|---|---|
| Sol-gel precursors | Formulae | Concentration of active charcoal (g/l) | Sol-gel reaction time before deposition | Sol-gel deposition with active charcoal (g/m$^2$) on cloth A (averages) |
| TMOS | $A_1$ | 40.2 | 65 h | 29 |
| TMOS | $A_2$ | 99.8 | 24 h | 37 |
| TMOS/MTM | B | 40.0 | 6 days | 22 |
| TMOS/APTES | $C_1$ | 40.0 | 6 h | 27 |
| TMOS/APTES | $C_2$ | 100.0 | 25 h | 36 |
| TMOS/APTES | $D_1$ | 40.0 | 2 h | 27 |
| TMOS/APTES | $D_2$ | 100.0 | 2 h | 42 |
| | | | 1 h 45 | 37 (cloth B) |
| | | | 1 h 45 | 435 (cloth C) |

TABLE 1-continued

| Strategy I | | | | |
|---|---|---|---|---|
| Sol-gel precursors | Formulae | Concentration of active charcoal (g/l) | Sol-gel reaction time before deposition | Sol-gel deposition with active charcoal (g/m$^2$) on cloth A (averages) |
| TMOS/APTES/17FTMOS | $E_1$ | 40.0 | 5 h | 30 |
| TMOS/APTES/17FTMOS | $E_2$ | 100.1 | 16 h 30 | 44 |
| TMOS/APTES/17FTMOS | $F_1$ | 40.0 | 1 h | 31 |
| TMOS/APTES/17FTMOS | $F_2$ | 100.2 | 2 h 20 | 40 |

TABLE 2

| Strategy II | | | | |
|---|---|---|---|---|
| Sol-gel precursors | Formulae | Concentration of active charcoal (g/l) | Sol-gel reaction time before deposition | Sol-gel deposition with active charcoal (g/m$^2$) on cloth A (averages) |
| TMOS | $A_1$' | 40.0 | 14 days | 21 |
| TMOS | $A_2$' | 100.0 | 28 days | 36 |
| TMOS/APTES | $D_1$' | 40.0 | 1 min | 28 |
| TMOS/APTES | $D_2$' | 100.0 | 35 min | 33 |
| TMOS/APTES/17FTMOS | $E_1$' | 40.1 | 5 min | 17 |
| TMOS/APTES/17FTMOS | $E_2$' | 100.0 | 10 days | 35 |
| TMOS/PhTMOS | $G_1$' | 10.0 | 3 days | 18 |
| TMOS/PhTMOS | $G_2$' | 20.0 | 10 days | 19 |
| TMOS/PhTMOS | $H_1$' | 20.0 | 3 days | 20 |
| TMOS/PhTMOS | $H_2$' | 40.0 | 21 days | 26 |

Example 2: Properties of the Impregnated Fabrics of Example 1

Scanning Electron Microscopy

In order to demonstrate the fact that the active charcoal is bonded to the textile by means of the presence of the sol-gel, the textiles were characterized by SEM before and after impregnation with the solutions.

Scanning Electron Microscopy (SEM) is a powerful technique for observation of the topography of surfaces. It is based mainly on the detection of secondary electrons emerging from the surface under the impact of a very fine beam of primary electrons which scans the observed surface and makes it possible to obtain images with a separating power often less than 5 nm and a great depth of field. The instrument makes it possible to form a almost parallel, very fine (down to a few nanometers) beam of electrons that are strongly accelerated by voltages adjustable from 0.1 to 30 keV, to focus it on the zone to be examined and to scan it progressively. Suitable detectors make it possible to collect significant signals during the scanning of the surface and to form various significant images therefrom. The images of the samples of the fabrics were produced with the "Ultra 55" SEM machine from Zeiss. The samples are observed directly without particular deposition (metal, carbon). A low acceleration voltage of 3 keV and the InLens detector (backscattered and secondary electron detector) allow observation of the samples and avoid a phenomenon of excessive charge due to the nature of the fabrics.

Figure 2:
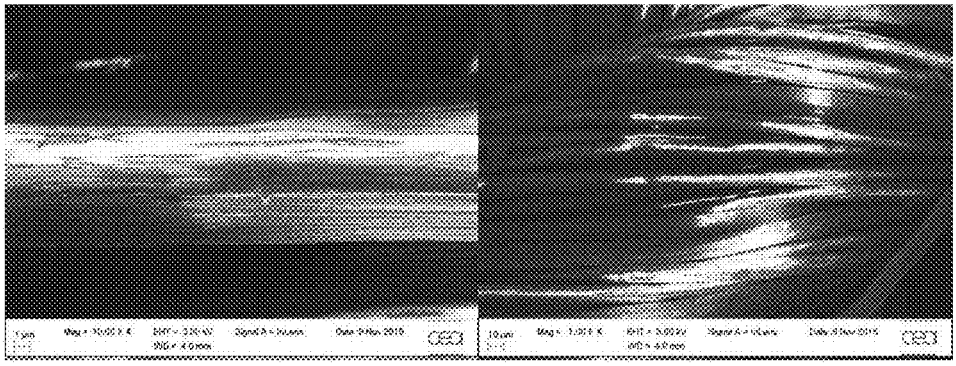
FIG. 2: SEM images of cloth B before impregnation.
Figure 3:
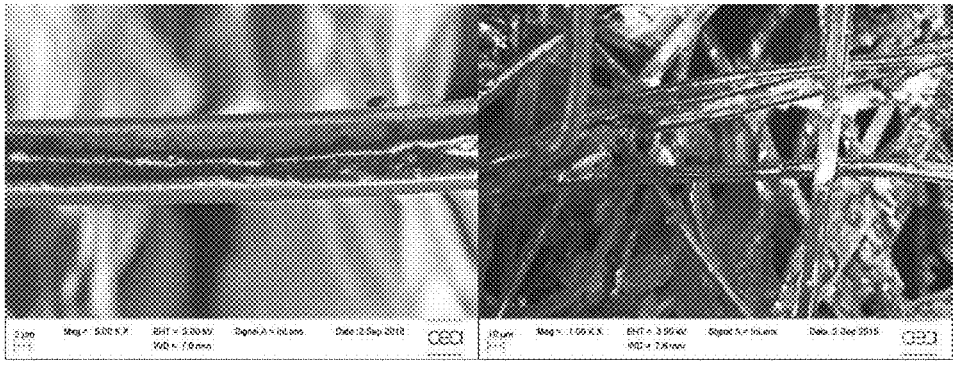
FIG. 3: SEM images of cloth C before impregnation.

The three cloths A, B and C (cloth A: 50/50 Kermel®/Lenzing fabric; cloth B: 50/50 Conex®/Lenzing fabric; cloth C: Nomex® felt) were observed before impregnation, without performing any particular preparation. The SEM images show that these three textiles have relatively smooth fibers (FIGS. 1 to 3), with a few roughnesses/grooves in the case of the two fabrics (FIGS. 2 and 3).

Figure 4:
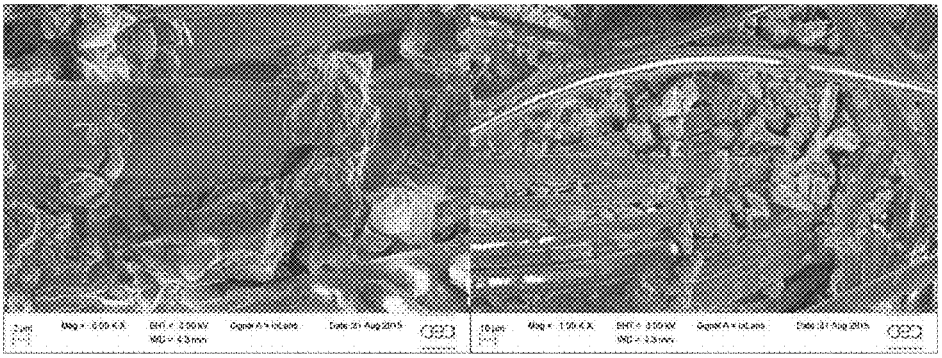
FIG. 4: SEM images of cloth A with impregnation of a sol-gel solution containing 40 g/l of active charcoal ($D_1$).
Figure 5:
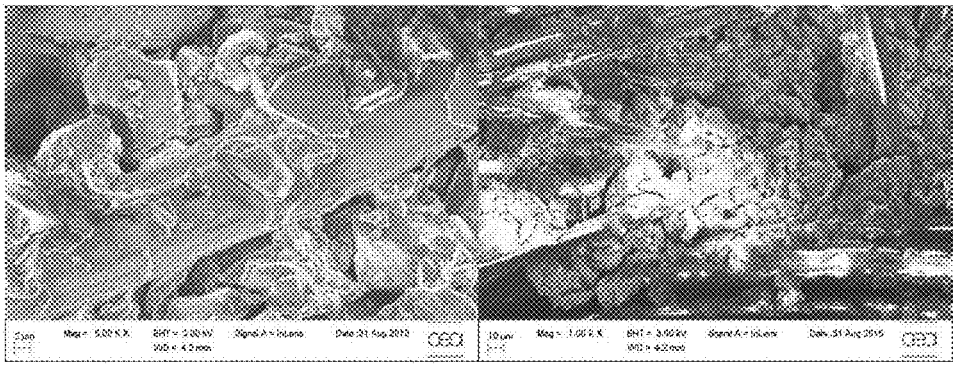
FIG. 5: SEM images of cloth A with impregnation of a sol-gel solution containing 100 g/l of active charcoal ($D_2$).
Figure 6:
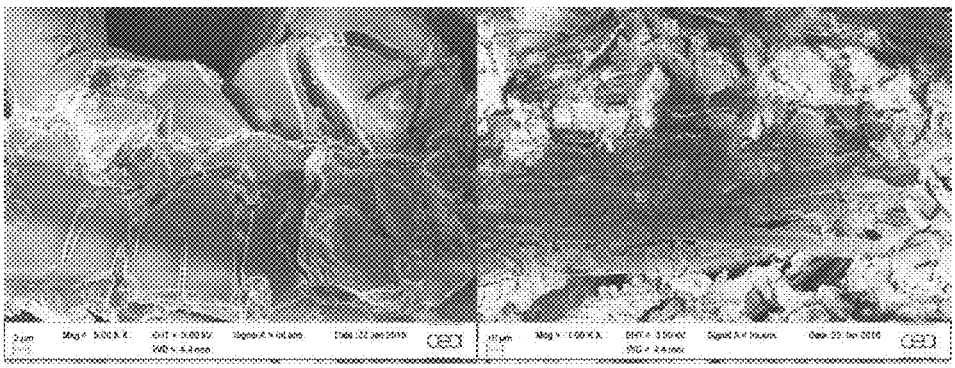
FIG. 6: SEM images of cloth A with impregnation of a sol-gel solution containing 100 g/l of active charcoal ($D'_1$).
Figure 7:
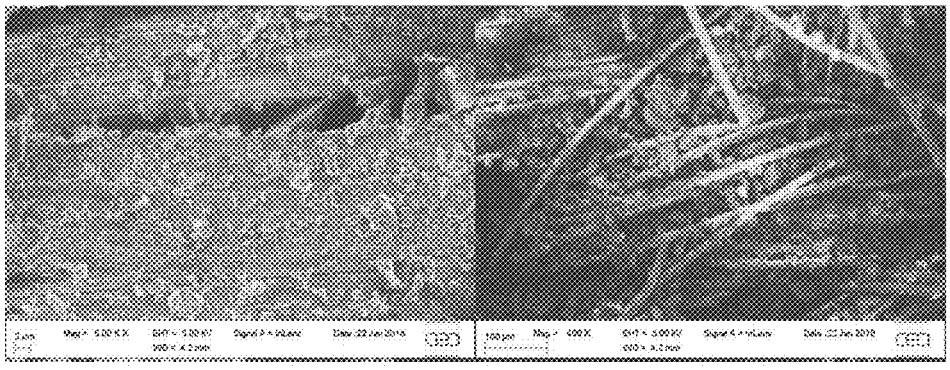
FIG. 7: SEM images of cloth A with impregnation of a sol-gel solution containing 100 g/l of active charcoal ($D'_2$).

The samples of cloth A impregnated with formulations $D_1$, $D_2$, $D_1$' and $D_2$' (example 1) were also observed by SEM. For formulations $D_1$ and $D_2$ prepared according to strategy I, the SEM images show that the sol-gel coats the active charcoal particles and binds them to the fibers forming a continuous cladding (FIGS. 4 and 5). The SEM images of the fabrics impregnated with formulations $D_1$' and $D_2$' prepared according to strategy II (FIGS. 6 and 7) show that the deposits are similar to those obtained with the solutions of strategy I. For the fabric impregnated with formulation $D_1$', it is in fact observed that the sol-gel, which is thicker and fractured, coats the active charcoal particles and binds them to the fibers, forming a cladding.

Figure 8:
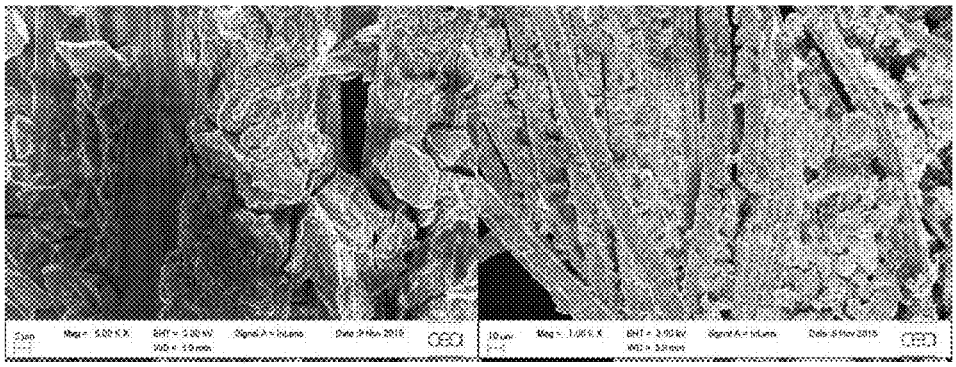
FIG. 8: SEM images of cloth B with impregnation of a sol-gel solution containing 100 g/l of active charcoal ($D_2$).
Figure 9:
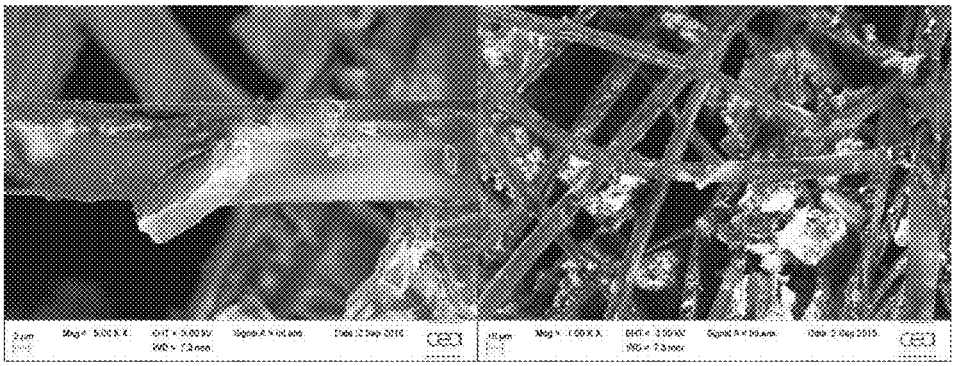
FIG. 9: SEM images of cloth C with impregnation of a sol-gel solution containing 100 g/l of active charcoal ($D_2$).
Figure 10:
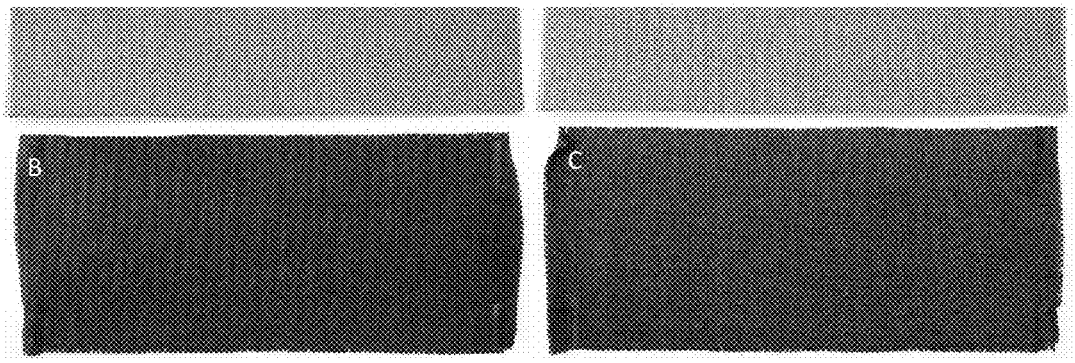
FIG. 10: Photographs of cloth A: (A) before impregnation, (B) front side after impregnation with formula $A_1$, (C) reverse side after impregnation with formula $A_1$.
Figure 11:
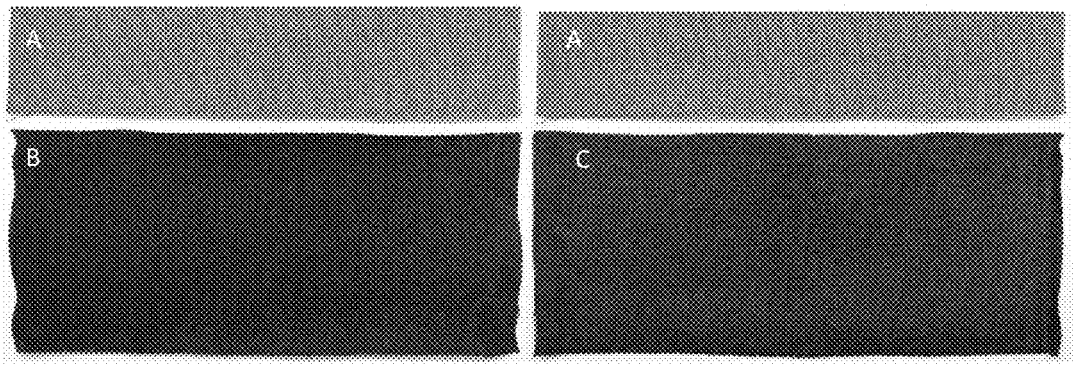
FIG. 11: Photographs of cloth A: (A) before impregnation, (B) front side after impregnation with formula $A_2$, (C) reverse side after impregnation with formula $A_2$.
Figure 12:
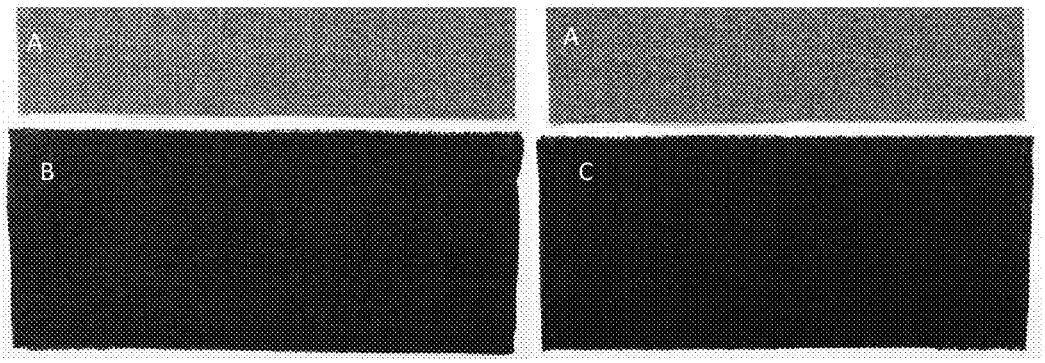
FIG. 12: Photographs of cloth B: (A) before impregnation, (B) front side after impregnation with formula $D_2$, (C) reverse side after impregnation with formula $D_2$.
Figure 13:
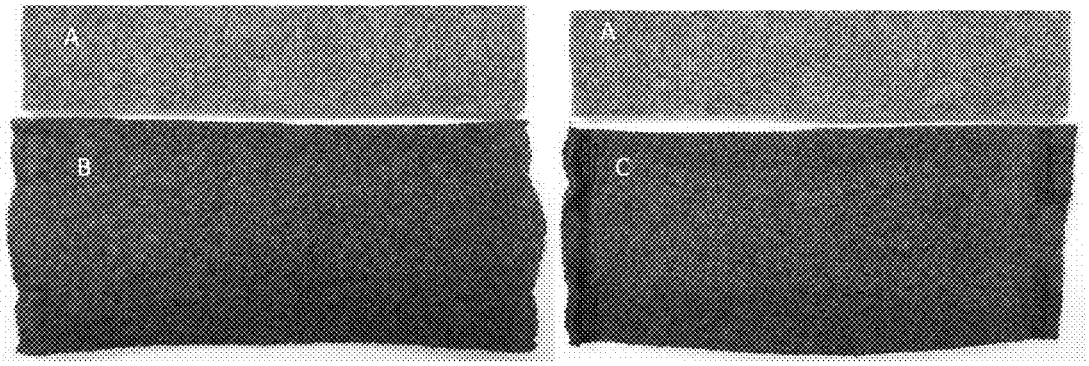
FIG. 13: Photographs of cloth C: (A) before impregnation, (B) front side after impregnation with formula $D_2$, (C) reverse side after impregnation with formula $D_2$.

The SEM images of the samples of cloths B and C impregnated with formulation $D_2$ (example 1) also show that the sol-gel coats the active charcoal particles and binds them to the fibers, forming a continuous cladding (FIGS. 8 and 9). The particles are spaced wider apart in the case of the felt, whereas lumps are visible in the case of the open fabric Conex®/Lenzing (cloth B).

Permeability to Air

For the purpose of the intended applications, notably in filtration, it is crucial for the textiles to be sufficiently permeable to air and/or to liquids. The permeability to air of the textiles was thus measured before and after deposition, according to the standard ISO 9237:1995 at 100 Pa. The results of the measurements are presented in table 3.

TABLE 3

| Textiles | Formula deposited | Deposition of sol-gel with active charcoal ($g/m^2$) | Permeability to air at 100 Pa ($l/m^2 \cdot s$) Before deposition | After deposition |
|---|---|---|---|---|
| Cloth A | $D_2$ | 42 | 139 | 22 |
| Cloth B | $D_2$ | 37 | 1032 | 122 |
| Cloth C | $D_2$ | 435 | 745 | 182 |

For cloths B and C, the permeability to air is lowered after deposition, but remains suitable. Moreover, the structure of the impregnated textile plays a predominant role on the permeability, since, for the same formula deposited, cloth C (felt) is eight times more permeable than cloth A (Kermel®/Lenzing cloth), with, however, a deposit that is ten times greater.

Visual Appearance

The deposition of sol-gel with active charcoal is uniform and modifies the appearance of the textiles, irrespective of their structure (FIGS. 10, 11, 12, 13). The sol-gel formula has no impact on the visual appearance of the textiles after deposition, unlike its active charcoal content: the higher the concentration, the more the color tends toward black.

Suppleness

The suppleness of the textiles before/after deposition is evaluated by a drape angle measurement.

Figure 14:
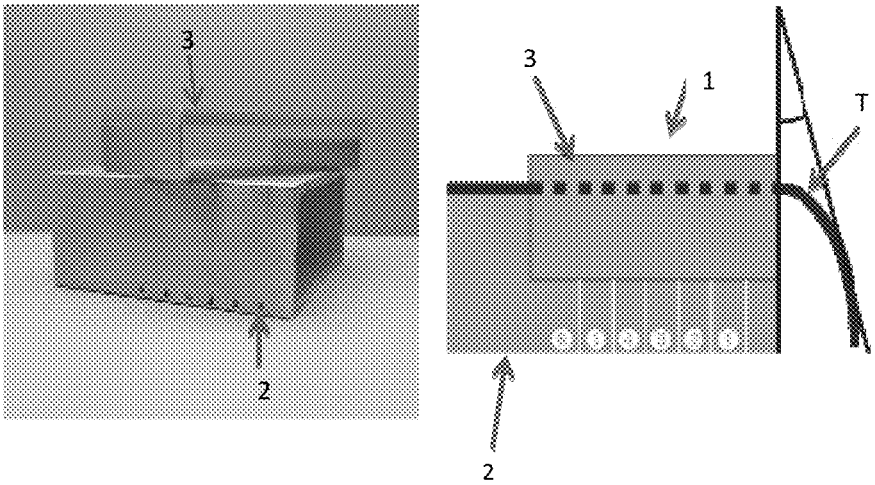
FIG. 14: (A) Schematic view of the components of the tool for measuring the drape of the fabric; (B) schematic diagram for the measurement of the drape of the fabric.

The suppleness of the textiles before/after impregnation was evaluated with the suppleness measurement tool shown in FIG. 14A. This tool 1 consists of two parts, a lower part 2 serving as a support for the fabric T and an upper part 3 which fits onto the lower part to block the fabric T. FIG. 14B shows the schematic diagram for the measurement. To take a measurement, 5 cm of fabric are positioned "in empty space", i.e. to the exterior of the measurement tool, a profile photograph is taken, and the angle $\alpha$ formed between the fabric and the vertical on the profile photograph is then measured using a protractor to evaluate the drape of the fabric.

Figure 15:
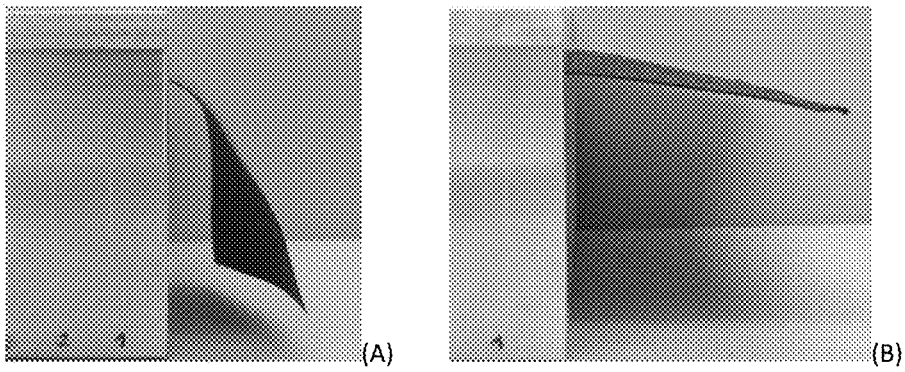
FIG. 15: (A) Photograph of the initial fabric in the tool for measuring the drape of the fabric; (B) photograph of the fabric impregnated with formula $D_2'$.

This tool allows a comparison of the samples with a reference (fabric without sol-gel) as shown by the photographs represented in FIG. 15.

Tables 3 and 4 below summarize the suppleness measurements before/after sol-gel deposition.

TABLE 4

| Strategy I | | | |
|---|---|---|---|
| Textiles | Formula deposited | Deposition of sol-gel with active charcoal ($g/m^2$) | Mean angle measured (°) |
| Cloth A | — | — | 18 |
| | $A_1$ | 29 | 83 |
| | $A_2$ | 37 | 81 |
| | B | 22 | 82 |
| | $C_1$ | 27 | 81 |
| | $C_2$ | 36 | 81 |
| | $D_1$ | 27 | 70 |
| | $D_2$ | 42 | 72 |
| | $E_1$ | 30 | 77 |
| | $E_2$ | 44 | 78 |
| | $F_1$ | 31 | 65 |
| | $F_2$ | 40 | 70 |
| Cloth B | — | — | 11 |
| | $D_2$ | 37 | 79 |
| Cloth C | — | — | 69 |
| | $D_2$ | 435 | 90 |

TABLE 5

| Strategy II | | | |
|---|---|---|---|
| Textiles | Formula deposited | Deposition of sol-gel with active charcoal ($g/m^2$) | Mean angle measured (°) |
| Cloth A | — | — | 18 |
| | $A_1'$ | 21 | 70 |
| | $A_2'$ | 36 | 50 |
| | $D_1'$ | 28 | 67 |
| | $D_2'$ | 33 | 81 |
| | $E_1'$ | 17 | 69 |
| | $E_2'$ | 35 | 69 |
| | $G_1'$ | 18 | 74 |
| | $G_2'$ | 19 | 64 |
| | $H_1'$ | 20 | 69 |
| | $H_2'$ | 26 | 73 |

As expected, the textiles are more rigid after deposition. These measurements also show that the suppleness of the textiles may vary with the sol-gel formulae (precursors) and their active charcoal concentration. Moreover, the textiles impregnated with the formulations according to strategy II are overall more supple than those impregnated with the formulations according to strategy I.

Hydrophobicity

The precursors used for the formation of the sol-gel may be chosen so as to provide water-repellency properties. Thus, formulations containing fluoro precursors (such as formulae $E_1$, $F_1$, $F_2$ and $E'_1$) make it possible to obtain hydrophobic fabrics. The hydrophobic properties of the fabrics impregnated with formulations $E_1$, $E_2$, $F_1$, $F_2$, $E'_1$ and $E'_2$ were determined by contact angle measurements with the OCA 15EC goniometer from DataPhysics and the software SCA20 in dynamic mode with the acquisition of 4 measurements per second for 1 minute in order to determine the stability of the water drop (10 μL) on the fabric. Table 7 below summarizes the mean contact angles on 2 or 3 measurements at t0.

TABLE 6

| Textile | Formula deposited | Hydrophobic | Contact angle (°) |
|---|---|---|---|
| Cloth A | — | No | 0 |
| | $E_1$ | Yes | 150 ± 5 |
| | $E_2$ | No | 0 |
| | $F_1$ | Yes | 165 ± 5 |
| | $F_2$ | Yes | 140 ± 5 |
| | $E_1'$ | Yes | 150 ± 5 |
| | $E_2'$ | No | 0 |

Example 3: Gas-Phase Filtration

The fabrics impregnated with each sol-gel formulation were exposed to gaseous mixtures containing methyl salicylate or toluene to test the trapping efficiency as a function of the porosity properties of the sol-gel materials and the intrapore polarity. The curves of piercing under gaseous streams were established for each pollutant.

3.1 Materials and Methods

Permeability of the Fabrics to Gases

In order to test the permeability of the fabrics to gases, a test bench was installed in the laboratory. For this, a "Porometer 3G, sample holder 37 mm" porometer from Quantachrome was used. This porometer allows the testing of a fabric 37 mm in diameter (cutting performed with a punch). The leaktightness is ensured by O-ring joints. Thus, the gas stream passes through all of the test fabric.

The fabric test bench consists of two 4-way valves upstream and downstream of the sample holder, for measuring the gas streams on either side of the sample holder. The tests showed that there is no (or little) loss of pressure in the presence of the test fabric. The measurements of the pollutant contents are performed in the gas stream after the sample holder using a PID detector (Photo-Ionization Detector) in order to obtain the pollutant piercing curve. The permeability of the fabrics was tested using two pollutants: toluene and methyl salicylate. Each pollutant has an intrinsic mode of exposure. These modes are described below.

Test of Permeability to Toluene:

For the toluene exposure tests, this pollutant is obtained from a bottle calibrated at 100 ppm (the flow meter used is in the range: 0-100 mL/min) and then diluted in dry nitrogen (the flow meter used is in the range: 0-1 L/min). The diluted gas stream is placed in contact with the test fabric. An initial toluene content of 3-4 ppm is used for the permeability tests.

Test of Permeability to Methyl Salicylate:

For the methyl salicylate exposure tests, the vapors of this pollutant are generated by bubbling with dry nitrogen (the flow meter used is in the range: 0-1 L/min). The stream of gas enriched in methyl salicylate is placed in contact with the test fabric. A thermostat/cryostat to adjust the temperature of the bubbler containing the methyl salicylate (coil) is used so as to ensure the reproducibility of the exposure tests. The bubbler containing the methyl salicylate is thus regulated at 20° C. By using a flow of dry nitrogen of 300 mL/min, an initial content of 55-60 ppm of methyl salicylate is obtained.

Methods for Exploiting the Methyl Salicylate Permeability Data

Figure 16:
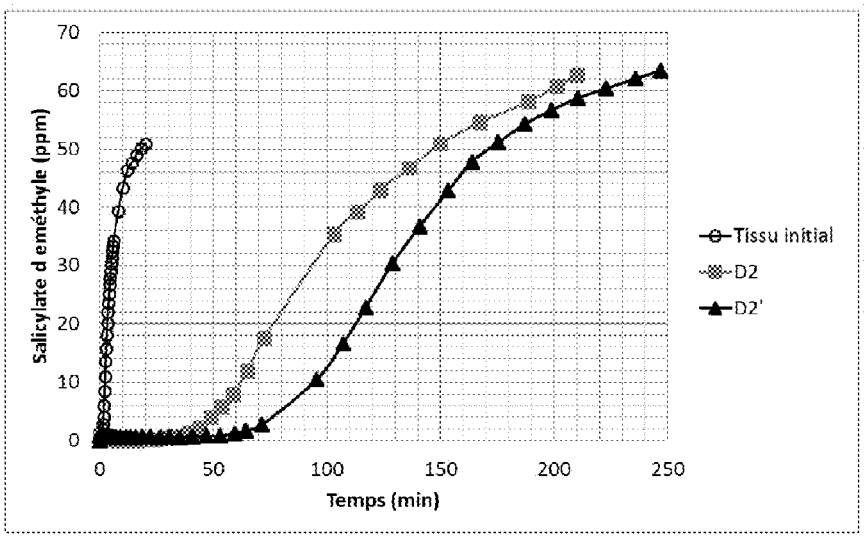
FIG. 16: Comparison of the normalized curves of methyl salicylate piercing with a deposition of 20 g/m$^2$ onto cloth A with formulae $D_2$ (strategy I) and $D_2'$ (strategy II).
Figure 17:
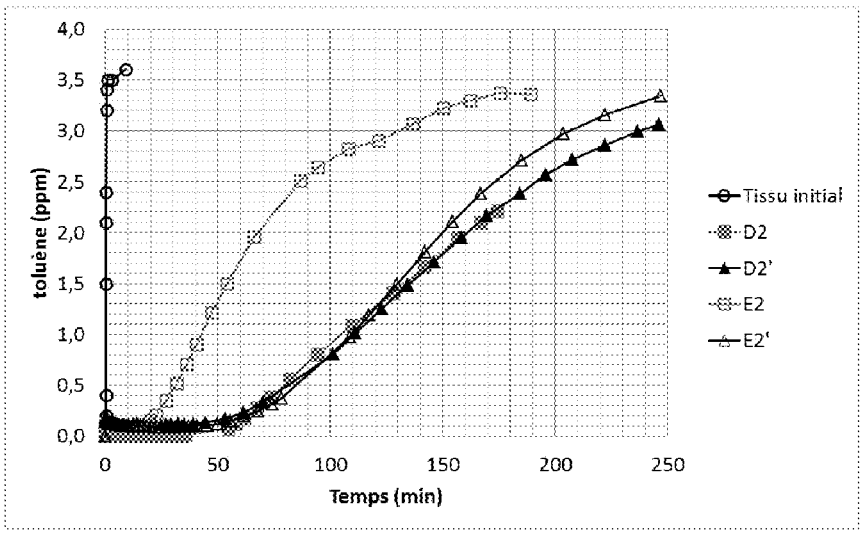
FIG. 17: Comparison of the normalized curves of toluene piercing with a deposition of 20 g/m$^2$ onto cloth A with formulae $D_2$ (strategy I), $D_2'$ (strategy II), $E_2$ (strategy I) and $E_2'$ (strategy II).

The methyl salicylate permeability tests consist in measuring the salicylate content (in ppm) as a function of time. This plot is known as a piercing curve, the "S" shape of which is more or less pronounced. Comparison of the methyl salicylate piercing curves normalized with a deposit of 20 g/m$^2$ for the initial fabric, formula $D_2$ (strategy I) and formula $D'_2$ (strategy II) is presented in FIG. 16.

The piercing curves obtained were exploited by two methods: decomposition of the piercing curve and modeling of the piercing curve. The two methods are detailed below.

Method 1: Decomposition of the Piercing Curve

The first method for evaluating the filtration consists in decomposing the piercing curve and in analyzing the total trapping times. The total trapping times are determined for a methyl salicylate content at 0 ppm (t @ 0 ppm), a methyl salicylate content of less than 1 ppm (t<1 ppm), less than 5 ppm (t<5 ppm) and less than 20 ppm (t<20 ppm). These total trapping times constitute the characteristic times of the decomposition method.

Method 2: Modeling of the Piercing Curve

The second method for evaluating the filtration consists in modeling the piercing curve by a sigmoid function according to the Hill model described below. This model was selected since, by definition, it allows modeling starting from the point (0,0), i.e.: a salicylate content of 0 ppm at t=0 min. This model, derived from enzymatic catalysis, models strictly positive data following a sigmoid ("S"-shaped curve), which indeed corresponds to the piercing curves obtained by exposing the fabrics impregnated with sol-gel to methyl salicylate.

The characteristic time of the piercing curve modeling method is thus: $t_{1/2}$. Furthermore, from the parameters of the model, the slope of the curve may be calculated. For this, two points are necessary: A ($t_A$; $T_A$) and B ($t_B$; $T_B$). The calculation of the coordinates and of the slope are noted in the table below.

Data Comparison: Normalization of the Characteristic Times

The masses per unit area of the sol-gel deposits range between 15 and 30 g/m$^2$. However, data comparison is only possible for an identical mass. Thus, to overcome the differences in masses per unit area, the characteristic times of the two methods described above were normalized to a mean deposit of 20 g/m$^2$. In practice, the normalization is calculated as follows:

$$|t(\text{min})| = \frac{t_{characteristic}(\text{min})}{\text{Experimental mass per unit area (g/m}^2)} \times \text{Mass per unit area of 20 g/m}^2$$

In this manner, the data are reported for an identical weight: comparison of the formulae is thus possible.

3.2 Results

Exposure to Methyl Salicylate

The results of the attachment strategies I and II are reported in Tables 7 and 8 below for the methyl salicylate trapping efficiency.

TABLE 7

| | Strategy I Time (min) | | | | | |
|---|---|---|---|---|---|---|
| | $\lvert t_{@\,0\,ppm}\rvert$ | $\lvert t_{<1\,ppm}\rvert$ | $\lvert t_{<5\,ppm}\rvert$ | $\lvert t_{<20\,ppm}\rvert$ | $\lvert t_{1/2}\rvert$ | Slope (ppm/min) |
| Cloth A without deposit | 0.0 | 1.0 | 1.5 | 3.0 | 4.2 | 6.42 |
| Formula $A_1$ | 16.2 | 25.0 | 32.4 | 42.2 | 52.6 | 1.68 |
| $A_2$ | 6.92 | 19.0 | 27.7 | 38.5 | 58.1 | 1.47 |
| B | — | 1.07 | 2.88 | 7.5 | 11.5 | 1.93 |
| $C_1$ | — | 11.3 | 17.4 | 23.4 | 31.6 | 3.32 |
| $C_2$ | — | 18.3 | 24.9 | 33.8 | 50.5 | 2.02 |
| $D_1$ | — | 11.2 | 17.9 | 25.4 | 36.5 | 2.61 |
| $D_2$ | 16.1 | 37.1 | 51.7 | 76.1 | 101.8 | 0.56 |
| $E_1$ | 7.12 | 14.4 | 19.6 | 27.8 | 33.5 | 2.25 |
| $E_2$ | 17.0 | 22.5 | 29.3 | 38.6 | 51.4 | 1.71 |
| $F_1$ | 13.6 | 19.1 | 21.2 | 36.9 | 40.9 | 1.17 |
| $F_2$ | 10.8 | 19.6 | 23.5 | 30.8 | 42.3 | 1.90 |
| Cloth B without deposit | 0.00 | 1.13 | 1.65 | 3.68 | 4.7 | 4.72 |
| Formula $D_2$ | 0.00 | 15.3 | 36.1 | 68.6 | 95.4 | 0.53 |
| Cloth C without deposit | 0.00 | 0.83 | 1.80 | 2.50 | 3.7 | 6.77 |
| Formula $D_2$ | 13.0 | 17.2 | 22.0 | 35.0 | 58.9 | 3.09 |

TABLE 8

| | Strategy II Time (min) | | | | | |
|---|---|---|---|---|---|---|
| | $\lvert t_{@0\,ppm}\rvert$ | $\lvert t_{<1\,ppm}\rvert$ | $\lvert t_{<5\,ppm}\rvert$ | $\lvert t_{<20\,ppm}\rvert$ | $\lvert t_{1/2}\rvert$ | Slope (ppm/min) |
| Cloth A without deposit | 0.0 | 1.0 | 1.5 | 3.0 | 4.2 | 6.42 |

TABLE 8-continued

| | | Strategy II Time (min) | | | | | |
|---|---|---|---|---|---|---|---|
| | | $\lvert t_{@0\ ppm}\rvert$ | $\lvert t_{<1\ ppm}\rvert$ | $\lvert t_{<5\ ppm}\rvert$ | $\lvert t_{<20\ ppm}\rvert$ | $\lvert t_{1/2}\rvert$ | Slope (ppm/min) |
| Formula | $D_1'$ | 45.6 | 53.2 | 64.9 | 84.7 | 99.4 | 0.81 |
| | $D_2'$ | — | 53.9 | 76.6 | 112 | 134.6 | 0.58 |
| | $E_1'$ | — | 17.4 | 22.5 | 31.1 | 39.1 | 1.36 |
| | $E_2'$ | — | 54.9 | 71.3 | 92.0 | 106.8 | 0.87 |
| | $G_1'$ | — | 21.6 | 31.6 | 44.1 | 49.5 | 1.19 |

The results obtained in the filtration of methyl salicylate show that the textiles are much more efficient after deposition. Moreover, all of the formulations tested according to attachment strategy II show better filtration performance than the formulations prepared according to attachment strategy I based on the same sol-gel precursors. These results clearly demonstrate that the incorporation of the polycarboxylic acid and of the catalyst modify the sol-gel, making it unsuitable for application in gas filtration. Similarly, the filtration performance qualities for the same formulation are better when the active charcoal concentration is higher.

The best result in terms of methyl salicylate permeability is obtained with formulation $D_2'$ according to strategy II. However, considering the results obtained with formulation $G_1'$, it is expected that the same formulation containing ten times more active charcoal (100 g/1) would make it possible to obtain a better result.

Moreover, successive deposits were tested to increase the mass per unit area of the filtering material. From 1 to 3 successive deposits of formula A1 were prepared. These led to masses per unit area of between 24 and 90 g/m$^2$. The methyl salicylate trapping efficiency results are indicated in table 9 below.

TABLE 9

| Successive deposits with strategy I | | | | |
|---|---|---|---|---|
| Formula | Deposit number | Mass per unit area (g/m$^2$) | $t_{1/2}$ (min) | Slope (ppm/min) |
| Initial fabric | 0 | 0 | 4.2 | 6.4 |
| A1 | 1 | 24 | 98.6 | 1.2 |
| | 3 | 90 | 180.8 | 0.8 |

Exposure to Toluene

As for methyl salicylate, the toluene permeability tests consist in measuring the toluene content (in ppm) as a function of time. This plot is known as a piercing curve, the "S" shape of which is more or less pronounced. Comparison of the toluene piercing curves normalized with a deposit of 20 g/m$^2$ for the initial fabric, formula $D_2$ (strategy I) and formula $D'_2$ (strategy II) is presented in FIG. 16.

The data exploitation methods are the same as for methyl salicylate. The attachment strategies I and II are compared in tables 10 and 11 below for the toluene trapping efficiency.

TABLE 10

| | | Strategy I Time (min) | | | |
|---|---|---|---|---|---|
| | | $\lvert t_{@\ 0\ ppm}\rvert$ | $\lvert t_{<1\ ppm}\rvert$ | $\lvert t_{<\ 2\ ppm}\rvert$ | $\lvert t_{<3\ ppm}\rvert$ |
| Cloth A without deposit | | 0.0 | 0.2 | 0.3 | 0.4 |
| Formula | $A_1$ | 17.5 | 44.1 | 78.3 | 161 |
| | $A_2$ | 30.8 | 93.8 | 145 | — |
| | B | 0.14 | 0.27 | 4.65 | 55.8 |
| | $C_1$ | 0.94 | 43.0 | 66.0 | 104 |
| | $C_2$ | 21.1 | 76.7 | 111 | 163 |
| | $D_1$ | 18.7 | 48.5 | 76.9 | 136 |
| | $D_2$ | 35.3 | 104 | 160 | — |
| | $E_1$ | 4.85 | 19.4 | 33.0 | 64.1 |
| | $E_2$ | 11.3 | 42.8 | 67.6 | 131 |
| | $F_1$ | 4.21 | 21.4 | 37.5 | 74.4 |
| | $F_2$ | 34.2 | 54.8 | 86.6 | — |
| Cloth C without deposit | | 0.00 | 0.27 | 0.82 | 26.0 |
| Formula | $D_2$ | 52.0 | 73.9 | — | — |

TABLE 11

| | | Strategy II Time (min) | | | |
|---|---|---|---|---|---|
| | | $\lvert t_{@\ 0\ ppm}\rvert$ | $\lvert t_{<1\ ppm}\rvert$ | $\lvert t_{<\ 2\ ppm}\rvert$ | $\lvert t_{<3\ ppm}\rvert$ |
| Cloth A without deposit | | 0.0 | 0.2 | 0.3 | 0.4 |
| Formula | $D_1'$ | 35.6 | 79.4 | 112 | 174 |
| | $D_2'$ | — | 111 | 161 | 237 |
| | $E_1'$ | — | 29.3 | 46.8 | 74.7 |
| | $E_2'$ | — | 110 | 150 | 206 |
| | $G_1'$ | — | 29.6 | 53.0 | 87.9 |

The results obtained in terms of the toluene permeability follow the same trends as those obtained in terms of the methyl salicylate permeability. Specifically, the toluene filtration performance is also greater with the attachment strategy II, and also with a higher concentration of active charcoal.

The best toluene permeability results are obtained with formulation $D'_2$, which also gave the best performance for methyl salicylate.

Example 4: Porosity of the Sol-Gel Materials with Active Charcoal

The porosity of the sol-gel materials was determined from the establishment of nitrogen adsorption isotherms (specific surface area, pore volume, pore size distribution). The intrapore polarity is revealed by the capacity of the material to more efficiently trap methyl salicylate in comparison with toluene.

4.1 Materials and Methods

Nitrogen adsorption consists of the physisorption of nitrogen on the surface of a solid: this is a reversible phenomenon (adsorption/desorption). Nitrogen adsorption a volumetric technique: a volume of gas of known temperature and pressure is sent onto the sample, which has been degassed beforehand and maintained at the temperature of liquid nitrogen. An adsorption isotherm corresponding to the volume of gas adsorbed as a function of the partial pressure of nitrogen is established. Interpretation of the adsorption isotherms is performed on the basis of various analytical models: Brunauer-Emmett-Teller (BET) model, which is a model of adsorption of a monomolecular layer of nitrogen molecules into the pores, and a model based on the density functional theory (DFT) which reproduces, with the aid of Monte Carlo methods, the adsorption isotherm for pores of given size. These analyses make it possible to obtain three pieces of information: the specific surface area for adsorption, the pore volume and the pore size distribution. The analyses were performed with the AUTOSORB-1 porosity analyzer from Quantachrome.

4.1 Results

The table below summarizes the polarity and the porosity of the sol-gel materials with active charcoal in the form of monoliths, obtained by BET analysis with nitrogen adsorption (specific surface area for adsorption, pore volume, pore size distribution).

TABLE 12

| Formula | Specific surface area ($m^2/g$) | | Pore volume | Micropore, mesopore and macropore size distribution (%) | | |
|---|---|---|---|---|---|---|
| | $S_{BET}$ | $S_{DFT}$ | ($cm^3/g$) | <20 Å | 20-500 Å | >500 Å |
| | | | Strategy I | | | |
| $A_2$ | 880 ± 80 | 810 ± 70 | 0.52 ± 0.01 | 56.5 | 44.5 | 0.0 |
| $D_1$ | 710 ± 50 | 680 ± 50 | 0.60 ± 0.02 | 51.5 | 49.5 | 0.0 |
| $D_2$ | 940 ± 80 | 940 ± 80 | 0.80 ± 0.05 | 53.9 | 47.1 | 0.0 |
| $E_2$ | 710 ± 50 | 690 ± 60 | 0.58 ± 0.02 | 72.0 | 28.0 | 0.0 |
| | | | Strategy II | | | |
| $D_1'$ | | 760 ± 60 | 740 ± 60 | 52.7 | 47.3 | 0.0 |
| $D_2'$ | 940 ± 80 | 900 ± 80 | 0.85 ± 0.05 | 48.5 | 51.5 | 0.0 |
| $E_2'$ | 910 ± 80 | 900 ± 80 | 0.74 ± 0.04 | 63.9 | 37.1 | 0.0 |

These results demonstrate above all that the composite material described in the invention (sol-gel with active charcoal) does indeed have substantial porosity, the presence of the sol-gel thus not blocking the pores of the active charcoal. Furthermore, and as expected, a higher concentration of active charcoal in the same sol-gel formulation leads to a higher specific surface area for adsorption and a higher pore volume. Finally, the sol-gel formulations according to strategy II have greater porosity (specific surface area for adsorption and pore volume) than those according to strategy I. For applications in filtration, strategy II again appears to be the most suitable.

The invention claimed is:

1. A process for coating a textile material, said process comprising the following steps:

a) incorporating active charcoal in powder form into a coating composition comprising an aqueous solvent and at least one organosilicon precursor, in which the organosilicon precursor represents 5% to 50% by volume relative to the combination of aqueous solvent and organosilicon precursor, b) impregnating the textile material by padding with the coating composition, and c) drying the impregnated textile material, optionally, before step b), applying a precoating composition, on the textile material, comprising an organic solvent and a zirconium alkoxide, said precoating composition being free of polycarboxylic acid, wherein the organosilicon precursor of the coating composition and the zirconium alkoxide of the optionally applied precoating solution are sole sources of metal impregnating and coating the coated textile, wherein the coating composition is free of polycarboxylic acid and of catalyst, and wherein the coated textile has improved polar and non-polar toxic gas barrier properties compared to the non-coated textile.

2. The process as claimed in claim 1, wherein the coating composition is also free of surfactant.

3. The process as claimed in claim 1, wherein the textile material is a fabric, a nonwoven or a knit.

4. The process as claimed in claim 1, wherein the textile material comprises fibers including hydrolyzable functions.

5. The process as claimed in claim 1, wherein the aqueous solvent is water or a mixture of water and of an organic solvent.

6. The process as claimed in clam 1, wherein the organosilicon precursor is chosen from tetramethoxysilane (TMOS), tetraethoxysilane (TEOS), methyltrimethoxy silane (MTM), methyltriethoxysilane (MTE), phenyltrimethoxysilane (PhTMOS), phenyltriethoxysilane (PhTEOS), a fluoroalkyltrimethoxysilane, a fluoroalkyltriethoxy silane, a chloroalkylmethoxysilane, a chloroalkylethoxysilane, an aminopropyltriethoxysilane, (3-glycidyloxypropyl)trimethoxysilane (GPTMOS) and mixtures thereof.

7. The process as claimed in claim 6, wherein the silicon precursor is tetramethoxysilane (TMOS).

8. The process as claimed in claim 6, wherein the organosilicon precursor is a mixture of tetramethoxysilane (TMOS) with one or more precursors chosen from methyl trimethoxysilane (MTM), methyl triethoxysilane (MTE), phenyltrimethoxysilane (PhTMOS), phenyl triethoxysilane (PhTEOS), fluoroalkyltrimethoxysilane, a fluoroalkyltriethoxysilane, a chloroalkyimethoxysilane, a chloroalkylethoxysilane, an aminopropyltriethoxysilane, (3-glycidyloxypropyl)trimethoxysilane (GPTMOS), and mixtures thereof.

9. The process as claimed in claim 8, wherein the organosilicon precursor is a mixture of tetramethoxysilane (TMOS) with aminopropyl triethoxysilane (APTES).

10. The process as claimed in claim 1, wherein it includes from 1 to 3 successive cycles of impregnation by padding.

11. The process as claimed in claim 1, wherein the process further comprises, before step b), a step of applying the precoating composition, on the textile material, comprising the organic solvent and the zirconium alkoxide, said precoating composition being free of polycarboxylic acid.

12. The process as claimed it claim 1, wherein the textile material is a fabric or a nonwoven.

13. The process as claimed in claim 1, wherein the organosilicon precursor is chosen from tetramethoxysilane (TMOS), methyltrimethoxysilane (MTM), phenyltrimethoxysilane (PhTMOS), a fluoroalkyltrimethoxysilane, a chloroalkylmethoxysilane, an aminopropyltriethoxysilane, (3-glycidyloxypropyl)trimethoxysilane (GPTMOS), and mixtures thereof.

14. The process as claimed in claim 1, wherein the textile material comprises fibers including hydroxyl functions.

* * * * *